US005570451A

United States Patent [19]

Sakaizawa et al.

[11] Patent Number: 5,570,451

[45] Date of Patent: Oct. 29, 1996

[54] IMAGE FORMING APPARATUS INCLUDING PLURAL IMAGE FORMING MEANS AND PLURAL RECORDING MEDIUM TRANSPORT PASSAGES

[75] Inventors: Katsuhiro Sakaizawa; Yasushi Satoh, both of Kawasaki; Yukihiro Ohzeki; Yasunori Chigono, both of Yokohama, all of Japan

[73] Assignee: Canon Kabushiki Kaisha, Tokyo, Japan

[21] Appl. No.: 324,504

[22] Filed: Oct. 18, 1994

[30] Foreign Application Priority Data

Oct. 21, 1993 [JP] Japan ..... 5-263527

[51] Int. Cl.[6] ..... G03G 15/00

[52] U.S. Cl. ..... 355/202; 347/4

[58] Field of Search ..... 355/202; 271/9, 271/13; 347/2, 3, 4

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,629,172 | 12/1986 | Kameyama et al. | 271/9.13 |
| 4,723,129 | 2/1988 | Endo et al. | 346/1.1 |
| 4,740,796 | 4/1988 | Endo et al. | 346/1.1 |
| 5,321,467 | 6/1994 | Tanaka et al. | 355/202 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Joan H. Pendegrass

*Attorney, Agent, or Firm*—Fitzpatrick, Cella, Harper & Scinto

[57] ABSTRACT

An image forming apparatus for forming an image on a recording medium has an image forming system for forming an image on the recording medium, a second image forming system for forming an image on the recording medium based on an image forming method different from that for the first image forming system, a first recording medium transport passage for discharging the recording medium out of the apparatus after the recording medium has passed through the first and second image forming systems, a second recording medium transport passage for discharging the recording medium out of the apparatus without passing the recording medium through the second image forming system after the recording medium has passed through the first image forming system, and a third recording medium transport passage for discharging the recording medium out of the apparatus without passing the recording medium through the first image forming system after the recording medium has passed through the second image forming system.

63 Claims, 16 Drawing Sheets

START

INPUT DATA P PRINT SHEETS
S1
S2
INK JET SYSTEM ONLY ?
YES
NO
S3
FEED RECORDING MEDIUM FROM FIRST FEED MEANS
S10
FEED RECORDING MEDIUM FROM SECOND FEED MEANS
FORM IMAGE BY ELECTROPHOTOGRAPHY SYSTEM
S4
FORM IMAGE BY INK JET SYSTEM
S5
P = P - 1
S6
DISCHARGE RECORDING MEDIUM
S7
S8
P = 0 ? SAME IMAGES ON PLURALITY OF SHEETS ?
NO
YES
S9
NEXT IMAGE FORMATION REQUIRED ?
YES
NO
END

IMAGE FORMING APPARATUS INCLUDING PLURAL IMAGE FORMING MEANS AND PLURAL RECORDING MEDIUM TRANSPORT PASSAGES

BACKGROUND OF THE INVENTION

1. Field of the Invention

This invention relates to an image forming apparatus having a plurality of image forming means based on different image forming methods.

2. Description of the Related Art

Image forming apparatuses such as copying machines and printers are frequently used in offices and the like, and apparatuses of this kind improved in image quality and recording speed have been developed. Recently, with the introduction of color techniques, there has been an increased demand for multicolor copying machines, multicolor printers and the like. However, the cost of multicolor recording is higher than that of monochromatic recording, and the recording speed of a multicolor recording system is considerably slower.

Multicolor copying machines and printers using a combination of different kinds of image forming means have recently been proposed. The structure of such apparatuses is, for example, as shown in FIG. 17. That is, image forming means A in accordance with an electrophotography method and image forming means B in accordance with an ink jet recording method are combined. As image forming means A, a photosensitive drum 50, a charging device 51, a development device 52, a transfer device 53, and a thermal fixation device 55 and other components are provided. The charging device 51, the development device 52 and the transfer device 53 are disposed around the photosensitive drum 50. Toner transferred to a recording medium 54 is fixed by the thermal fixation device 55. As image forming means B, a plurality of ink jet heads 56 are provided to perform multicolor recording. Recording medium 54 is transported from the image forming means A to the image forming means B.

In the above-described apparatus, in the case of black-and-white recording, the image forming means A produces an image at high speed with high image qualities, using the electrophotography method. On the other hand, in the case of multicolor recording, the image forming means B produces a multicolor image at low cost, using the ink jet recording method. It is thus possible to provide an apparatus capable of performing low-cost multicolor recording and high-quality, high-speed black-and-white recording.

In the above-described arrangement, however, a unit 57 for supplying recording medium to an image forming section is provided only for the image forming means A, and there are, therefore, the problems described below.

For example, in a case where recording medium 54 on which a document or a graphic has already been recorded by a different copying machine or the like is supplied to record characters "Secret Document" or the like in one color, e.g., vermilion, the recording medium 54 passes through the thermal fixation device 55 in the image forming means A before being transported to the image forming means B.

In such a situation, depending upon variations of the kind of recording medium 54, i.e., plain paper and the like (including, for example, surface properties and mold release properties) and variations in toner properties (e.g., variations in toner melting temperature), there is a possibility of the toner image already formed on the recording medium 54 being again melted when the medium passes through the fixation device 55. The molten toner attaches to a fixation roller 55*a*, and the toner on the roller again attaches to the transported recording medium 54. That is, there is a risk of occurrence of a phenomenon called "offset".

Also, an over head projector (OHP) sheet specially prepared for ink jet recording by being coated with a material for retaining ink thereon may be used as a recording medium. Such an OHP sheet cannot be passed through the fixation device 55, because the ink retaining material is easily affected by heat.

The order of image forming processing in the above-described conventional apparatus may be reversed, that is, the image forming apparatus may alternatively be such that image forming means A is provided as an ink jet system while image forming B is provided as an electrophotography system. Also in this case, the recording medium must pass through the fixation device 55, and the same problem is therefore encountered.

Also, even if an operator wishes to output only a color image (use only the ink jet system), it is necessary to operate the electrophotography system in order to transport recording medium 54. Unnecessarily large electric power is therefore required.

That is, if two or more kinds of image forming means are combined, a strong point of one of them, which is to be fully utilized, can be damaged due to a weak point of another one of them.

SUMMARY OF THE INVENTION

An object of the present invention is to provide an image forming apparatus capable of producing a high-quality black-and-white image and a high-quality color image.

Another object of the present invention is to provide an image forming apparatus having a recording speed higher than that of the above-described conventional apparatus in the case of forming only black-and-white images or only color images.

Still another object of the present invention is to provide an image forming apparatus in which different kinds of image forming means do not influence each other in the case of forming only black-and-white images or only color images.

According to a first aspect of the present invention, an image forming apparatus for forming an image on a recording medium includes first and second image forming units, and first, second, and third recording medium transport passages. The first image forming unit forms an image on the recording medium using a first image forming method. Likewise, the second image forming unit forms an image on the recording medium using a second image forming method. The first recording medium transport passage discharges the recording medium out of the apparatus after the recording medium has passed through the first and second image forming units. The second recording medium transport passage discharges the recording medium out of the apparatus without passing the recording medium through the second image forming unit after the recording medium has passed through the first image forming unit. The third recording medium transport passage discharges the recording medium out of the apparatus without passing the recording medium through the first image forming unit after the recording medium has passed through the second image forming unit.

According to another aspect of the present invention, an image forming apparatus for forming an image on a recording medium includes first and second image forming units, first and second stacking units, first and second receiving units, and first, second, and third recording medium transport passages. The first image forming unit forms an image on the recording medium based on a first image forming method. The second image forming unit forms an image on the recording medium based on a second image forming method. The first and second stacking units stack the recording medium to be fed to the first and second image forming units, respectively. The first and second receiving units receive the recording medium on which an image is formed. The first recording medium transport passage discharges the recording medium out of the apparatus after the recording medium has passed through the first and second image forming units. The second recording medium transport passage discharges to the first receiving unit the recording medium fed out of the first stacking unit after the recording medium has passed through the first image forming unit. The third recording medium transport passage discharges to the second receiving unit the recording medium fed out of the second stacking unit after the recording medium has passed through the second image forming unit.

According to a further aspect of the present invention, an image forming apparatus for forming an image on a recording medium includes first and second image forming units, first and second stacking units, first and second receiving units, and first, second, and third recording medium transport passages. The first and second image forming units form images on the recording medium using first and second image forming methods, respectively. The first stacking unit stacks the recording medium to be fed to the first image forming unit, and the second stacking unit stacks the recording medium to be fed to the second image forming unit. The first and second receiving units receive the recording medium on which an image is formed. The first recording medium transport passage discharges to the first receiving unit the recording medium fed out of the first stacking unit after the recording medium has passed through the first image forming unit and then through the second image forming unit. The second recording medium transport passage branches from the first recording medium transport passage on the downstream side of the first image forming unit and on the upstream side of the second image forming unit along a recording medium transport direction. The recording medium on which the image has been formed by the first image forming unit is discharged to the second receiving unit through the second recording medium transport passage. The third recording medium transport passage discharges to the first receiving unit the recording medium fed out of the second stacking unit after the recording medium has passed through the second image forming unit.

According to a still further aspect of the present invention, an image forming apparatus for forming an image on a recording medium includes first and second image forming units, and first, second, and third recording medium transport passages. The first image forming unit forms an image on the recording medium using an electrophotographic image forming method. The second image forming unit forms an image on the recording medium using an ink jet image forming method of forming an image by ejecting ink through an outlet. The first recording medium transport passage discharges the recording medium out of the apparatus after the recording medium has passed through the first and second image forming units. The second recording medium transport passage discharges the recording medium out of the apparatus without passing the recording medium through the second image forming unit after the recording medium has passed through the first image forming unit. The third recording medium transport passage discharges the recording medium out of the apparatus without passing the recording medium through the first image forming unit after the recording medium has passed through the second image forming unit.

According to a still further aspect of the present invention, an image forming apparatus for forming an image on a recording medium includes first and second image forming units, first and second stacking units, first and second receiving units, and first, second, and third recording medium transport passages. The first image forming unit forms an image on the recording medium using an electrophotographic image forming method. The second image forming unit forms an image on the recording medium using an ink jet image forming method of forming an image by ejecting ink through an outlet. The first and second stacking units stack the recording medium to be fed to the first and second image forming units, respectively. The first and second receiving units receive the recording medium on which an image is formed. The first recording medium transport passage discharges the recording medium out of the apparatus after the recording medium has passed through the first and second image forming units. The second recording medium transport passage discharges to the first receiving unit the recording medium fed out of the first stacking unit after the recording medium has passed through the first image forming unit. The third recording medium transport passage discharges to the second receiving unit the recording medium fed out of the second stacking unit after the recording medium has passed through the second image forming unit.

According to still another aspect of the present invention, an image forming apparatus for forming an image on a recording medium includes first and second image forming units, first and second stacking units, first and second receiving units, and first, second, and third recording medium transport passages. The first image forming unit forms an image on the recording medium using an electrophotographic image forming method. The second image forming unit forms an image on the recording medium using an ink jet image forming method of forming an image by ejecting ink through an outlet. The first and second stacking units stack the recording medium to be fed to the first and second image forming units, respectively. The first and second receiving units receive the recording medium on which an image is formed. The first recording medium transport passage discharges to the first receiving means the recording medium fed out of the first stacking unit after the recording medium has passed through the first image forming unit and then through the second image forming unit. The second recording medium transport passage branches off the first recording medium transport passage on the downstream side of the first image forming unit and on the upstream side of the second image forming unit, along a recording medium transport direction. The recording medium on which the image has been formed by the first image forming unit is discharged to the second receiving unit through the second recording medium transport passage. The third recording medium transport passage discharges to the first receiving means the recording medium fed out of the second stacking unit after the recording medium has passed through the second image forming unit.

DESCRIPTION OF THE PREFERRED EMBODIMENTS

The preferred embodiments of the present invention will be described below with reference to the accompanying drawings.

First Embodiment

Figure 1:
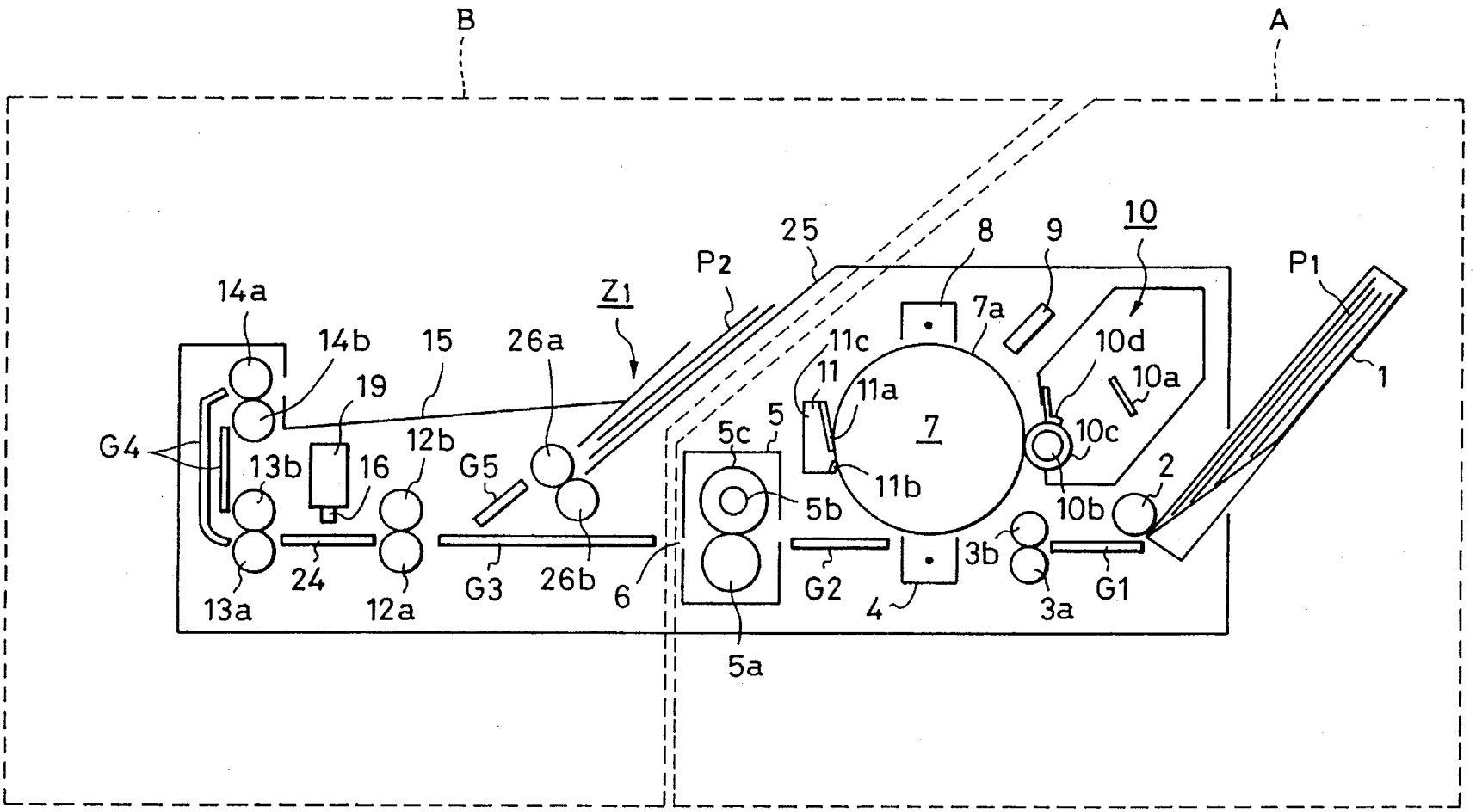
FIG. 1 is a schematic diagram of the overall construction of an image forming apparatus in accordance with a first embodiment of the present invention.

Referring to FIG. 1, an image forming apparatus in accordance with the first embodiment of the present invention has a plurality of sets of image forming means based on different image forming methods, and uses an electrophotography system as first image forming means A and an ink jet recording system as second image forming means B.

Construction of First Image Forming Means A

Figure 2:
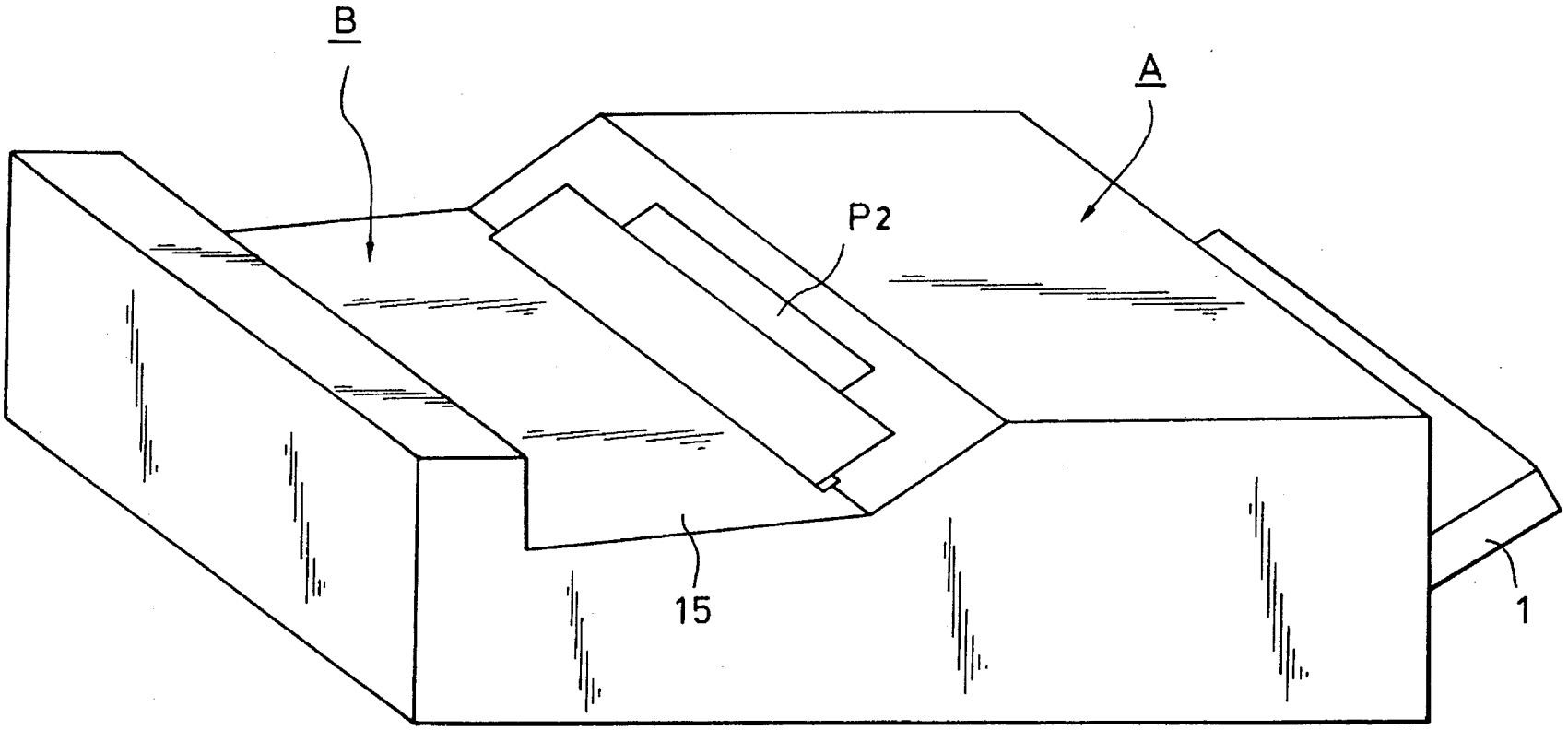
FIG. 2 is a perspective view of an external appearance of the image forming apparatus in accordance with the first embodiment.

First image forming means A is provided mainly to perform black-and-white recording and includes a recording means described below. The recording means projects an optical image formed in accordance with image information onto photosensitive drum 7 provided as an image carrier to form an image of a developer (hereinafter referred to as "toner") on the drum. In synchronization with the formation of the toner image, a recording medium sheet P1 is transported from a cassette 1, shown in FIGS. 1 and 2, by a transport means consisting of a pickup roller 2, a guide member G1, a pair of registration rollers 3*a*, 3*b*, and other components. At the recording means, the toner image formed on photosensitive drum 7 is transferred to the recording medium P1 by applying a voltage to a transfer charging device 4 provided as a transfer means, and the recording medium P1 is transported to a fixation means 5 along a guide member G2. The fixation means 5 includes a drive roller 5*a* and a fixation roller 5*c* incorporating a heater 5*b* and operates to fix the transferred toner image by applying heat and pressure to the recording medium P1 passing through it. After toner image fixation, the recording medium P1 is discharged from the fixation means 6 to a discharge port 6.

In the recording means, as shown in FIG. 1, a photosensitive drum 7 having a photosensitive layer 7*a* is rotated and a surface of the photosensitive drum 7 is uniformly charged by application of a voltage to a charging means, i.e., a primary charging device 8. Also in the recording means, the photosensitive drum 7 is exposed by an exposure device 9 to form a latent image, which is developed by a development means 10. In the development means 10, the toner in a toner container is fed out by a toner feeding member 10*a*, a development sleeve 10*c* incorporating a fixed magnet 10*b* is rotated, and a toner layer having frictional electrification charge is formed on the surface of the development sleeve 10*c* by a development blade 10*d*. The toner on the development sleeve 10*c* is supplied to the photosensitive drum 7 in accordance with the latent image to form a toner image as a visible image. The toner image is transferred to the recording medium P1 by applying a voltage having a polarity opposite to that of the toner image to the transfer charging device 4. Thereafter, the residual toner remaining on the photosensitive drum 7 is removed by a cleaning means 11 in such a manner that the residual toner is scraped off by a cleaning blade 11a and scooped up by a scoop sheet 11*b* to be collected in a waste toner container 11*c*.

Construction of Second Image Forming Means B

The second image forming means B will be described. The second image forming means B is provided mainly to perform color recording and is constructed as described below with reference to FIGS. 1, 2 and 3. The recording medium sheet P1 discharged out of the discharge port 6 is transported to a recording means described below by a guide member G3 and a pair of transport rollers 12*a*, 12*b*. The recording medium P1 after recording is transported by a pair of discharge rollers 13*a*, 13*b* and is transported in a U-turn manner by a guide member G4 and a pair of discharge rollers 14*a*, 14*b* to be discharged into a discharge section 15, shown in FIGS. 1 and 2.

An ink jet recording system having a recording head assembly 16 for ejecting ink for recording is used as the above-mentioned recording means. That is, the recording head assembly 16 is formed of unit heads each having fine liquid outlets (orifices), liquid passages, energy application sections as portions of the liquid passages, and energy generation means for generating liquid droplet forming energy acting on a liquid at the energy application members.

There are various recording methods using such energy generation means for generating energy, for example, a recording method using an electromechanical transformer such as a piezoelectric element, a recording method using energy generation means for developing heat by irradiation of electromagnetic waves to eject a liquid droplet by the heating effect, and a recording method using energy generation means for heating a liquid by using an electrothermal transducer such as a heating device having a heating resistor to eject the liquid.

Recording heads used for ink jet recording methods of ejecting a liquid by thermal energy among such recording methods are capable of high-resolution recording, because they can be constructed so that liquid ejection ports (orifices) for ejecting liquid droplets for recording to form ejected liquid droplets can be arranged at a high density. Among such recording heads, one using an electrothermal transducer as a thermal energy generation means is particularly advantageous, because it can be easily designed so as to be small in size and can be manufactured by sufficiently utilizing the advantages of the IC technology and micromachining technology which have recently progressed remarkably in techniques and reliability in the semiconductor field, and also because it can be easily adapted for a high-density packaging design and can be manufactured at a low cost.

In this embodiment, therefore, an electrothermal transducer is used as energy generation means.

Figure 3:
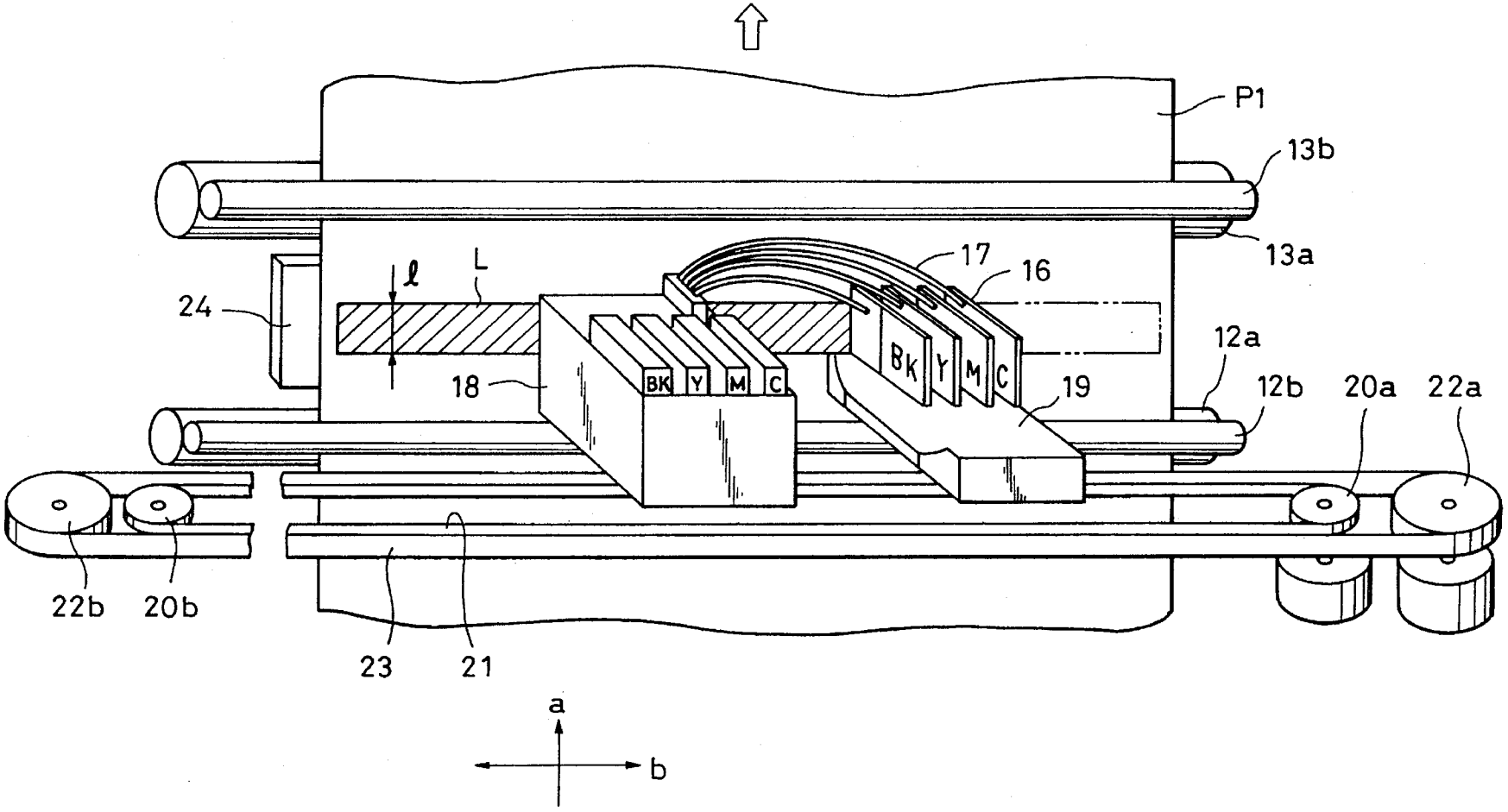
FIG. 3 is a diagram of image formation based on an ink jet recording method.

In the recording means, as shown in FIG. 3, the recording head assembly 16 is formed of heads for ejecting color inks of cyan (C), magenta (M), yellow (Y) and black (Bk), each head having a plurality of ink ejection ports arranged in the direction of arrow a. Each ink is supplied from an ink tank 18 through an ink supply tube 17 to each head of the recording head assembly 16. The recording head assembly 16 is mounted on a carriage 19 which is fixed on a portion of a belt 21 stretched between a drive pulley 20*a* and a follower pulley 20*b*, and which is reciprocatingly moved along a guide (not shown) in a main scanning direction (indicated by arrow b in FIG. 3) with high accuracy. The ink tank 18 is fixed on a portion of a belt 23 stretched between a drive pulley 22*a* and a follower pulley 22*b*, and is movable along a guide (not shown) in the direction of arrow b, as in the case of the recording head assembly 16. The ink tank 18 is moved to prevent the ink supply tubes 17 from being stressed, and is driven independently of the carriage 19 to prevent propagation to the recording head assembly 16 of vibrations or the like generated by moving the relatively heavy ink tank 18.

The recording medium sheet P1 is pinched between the pair of transport rollers 12*a*, 12*b*, and the pair of discharge rollers 13*a*, 13*b*. Recording is performed by the recording head assembly 16 between the pair of rollers 12*a*, 12*b*, and the pair of rollers 13*a*, 13*b*. The transporting speed of the pair of discharge rollers 13*a*, 13*b* is selected so as to be slightly higher than that of the pair of transport rollers 12*a*, 12*b*, whereby the desired flatness of the recording medium sheet P1 is maintained between the two pairs of rollers 12*a*, 12*b*, and 13*a*, 13*b*. Alternatively, to maintain the desired flatness of the recording medium sheet P1, the sheet may be attracted to a platen having a flat surface portion in an electrostatic attraction of air attraction manner.

Once the recording sheet P1 is stopped, recording using the recording head assembly 16 in accordance with an image signal is started from a left end side of the recording medium sheet P1, and image or the like is thereby recorded as represented by a recording line L, until the head assembly reaches a right end side of the medium sheet. When recording for one line is completed, the carriage 19 and the ink tank 18 are returned to the left end. During this returning movement, the recording medium sheet P1 is fed in the direction of arrow a shown in FIG. 3 through a distance corresponding to one line by the pair of transport rollers 12*a*, 12*b*, and the pair of discharge rollers 13*a*, 13*b* and then the sheet P1 is stopped again. This sequence of operations is repeated to perform color recording on the recording medium P1.

In the above-described manner, it is possible to perform high-speed black-and-white recording by the first image forming means A and to thereafter perform low-cost color recording by transporting the recording medium P1 to the second image forming means B.

Color recording referred to in this specification includes mono-color recording using one color selected from black and other colors, as well as full-color recording.

Recording Medium Supply Means

In this embodiment, means Z1 for supplying a recording medium P2 is provided between the first image forming means A and the second image forming means B apart from the cassette 1 and the pickup roller 2 for supplying the recording medium P1 to the first image forming means A. The recording medium P2 can be supplied directly to the second image forming means B. Incidentally, a cassette is a unit containing a recording medium and capable of being detachably attached to the apparatus body.

More specifically, as shown in FIG. 1, a manual insertion tray 25 is provided between the first image forming means A and the second image forming means B, and a pair of pickup rollers 26*a*, 26*b*, and a guide member G5 for supplying recording medium P2 on the tray 25 to the pair of transport rollers 12*a*, 12*b* is also provided.

Accordingly, if an operator wishes to record an image or the like by mono-color or full-color recording on a sheet of recording medium P2 on which a black-and-white document or the like has already been recorded by this apparatus or a different copying machine or on a blank sheet of recording medium P2 on which no image is formed, the operator sets the recording medium sheet P2 on the manual insertion tray 25. That is, if a recording signal only for the second image forming means B is input, the pickup rollers 26*a*, 26*b* are driven to supply the recording medium sheet P2 set on the manual insertion tray 25 to the pair of transport rollers 12*a*, 12*b*. The recording medium P2 is transported by the pair of rollers 12*a*, 12*b*, and the pair of discharge rollers 13*a*, 13*b*, mono-color recording or full-color recording is performed on the recording medium P2, and the recording medium P2 is thereafter discharged into the discharge section 15.

Functional blocks of the image forming apparatus for controlling the operation of driving of the above-described components will be described with reference to FIG. 4.

Figure 4:
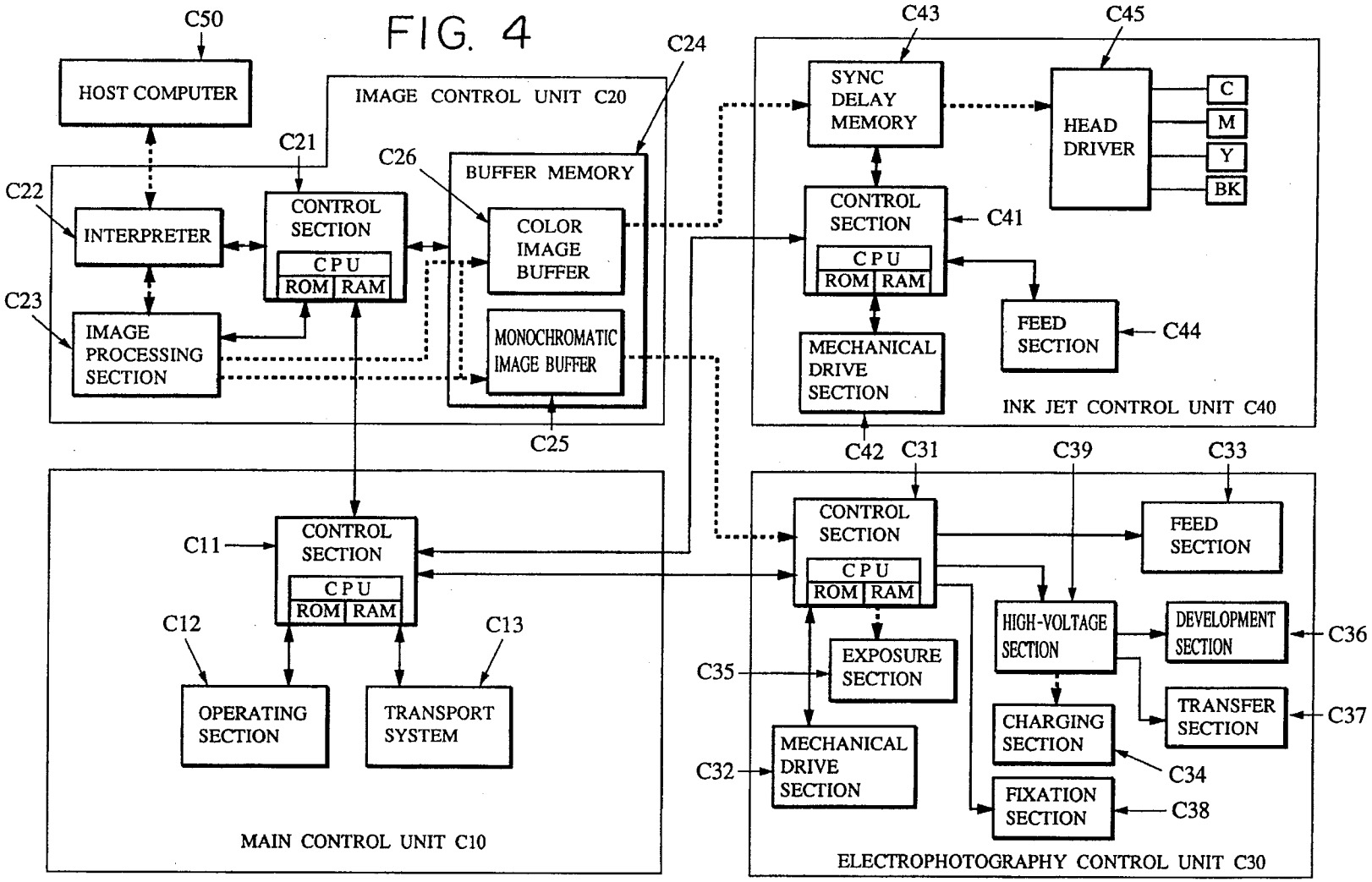
FIG. 4 is a block diagram of a control system.

Referring to FIG. 4, a main control unit C10, an image control unit C20, an electrophotography control unit C30 and an ink jet control unit C40 have control sections C11, C21, C31, and C41, respectively, for controlling the components. Each of the control sections C11, C21, C31, and C41 is constituted of a central processing unit (CPU) consisting of a microcomputer or the like for performing necessary operational processing and determination processing, a ROM in which various programs for operating the CPU are stored, a RAM for storing instruction data for the CPU and other various kinds of data, a communication circuit and the like.

Connections are established between the control sections C11 and C21, between the control sections C11 and C31, and between the control sections C11 and C41 by communication lines. A form of master-slave control is adopted such that each of the control sections C21, C31, and C41 operates by an instruction from the control section C11.

The main control unit C10 includes an operating section C12 and a recording medium transport system C13. The operating section C12 has, for example, a liquid crystal display as a display unit and a touch panel having a transparent electrodes and provided on the surface of the liquid crystal display, and serves to input selection instructions for designating colors, changing the image density and interfaces, and the like. The recording medium transport system C13 operates to perform an overall control of the operations of transporting the recording media P1 and P2.

The control system of this embodiment includes no control section for controlling a sorter means, i.e., a means for sorting discharged cut sheets is not provided. If a sorter means and a control of the sorter means are required, a controller or driver for the sorter means may be connected to the main control unit C10 to control the sorter means by the control section C11.

In the image control unit C20, the control section C21 controls an interpreter C22 for interpreting signals input to the control section C21, and image processing section C23 for performing various kinds of image processing, and a buffer memory C24 for storing image data. The interpreter C22 is connected to a host computer C50 by a general-use parallel interface, e.g., the GB-1B interface or the like. The interpreter C22 translates an image signal from the host computer C50 into suitable data and transfers the data to the image processing section C23. In the image processing section C23 are performed image area separation processing for separating the input data into data on characters, texts and diagrams and data on photographs, natural pictures and other images, smoothing processing, edge enhancement processing, black extraction, masking processing for color correction of recording inks used in the recording head assembly 16, and the like. Data on characters, texts, diagrams and the like is transferred to, and stored in, a monochromatic image buffer C25 and a color image buffer C26, and data on photographs, natural pictures and other images is transferred to and stored in the color image buffer 26.

The color image buffer 26 has memories for four colors, which are necessary to clearly output black in the case of forming a color image only by the second image forming means B.

The electrophotography control unit C30 is controlled by the control section C31, and includes a mechanical drive section C32, a feed section C33 for supplying recording medium P1, and sections for performing steps of an electrophotography process, i.e., a charging section C34, an exposure section C35, a development section C36, a transfer section C37, and a high-voltage section for applying a high voltage to each of the charging section C34, the development section C36 and the transfer section C37 by suitable timing.

Data in the monochromatic image buffer C25 is transferred to the control section C31 and a sequence of image forming steps is performed by the above-mentioned electrophotography system.

The ink jet control unit C40 is controlled by the control section C41, and includes a mechanical drive section C42, a sync delay memory C43, a feed section C44, a head driver C45, including control C46 for each color recorded by recording head 16.

The sync delay memory C43 receives image data from the color image buffer C24, and also serves to absorb variations in the times taken for the mechanical operations of the ink jet control unit C40 as well as to generate signals for determining timings necessary for driving the recording head assembly 16.

The head driver C45 is an analog drive circuit for driving the recording head assembly 16. Signals for directly driving the recording head assembly 16 are generated in the head driver C45. The recording head assembly 16 ejects inks of cyan, magenta, yellow and black to form an image on the recording medium.

Figure 5:
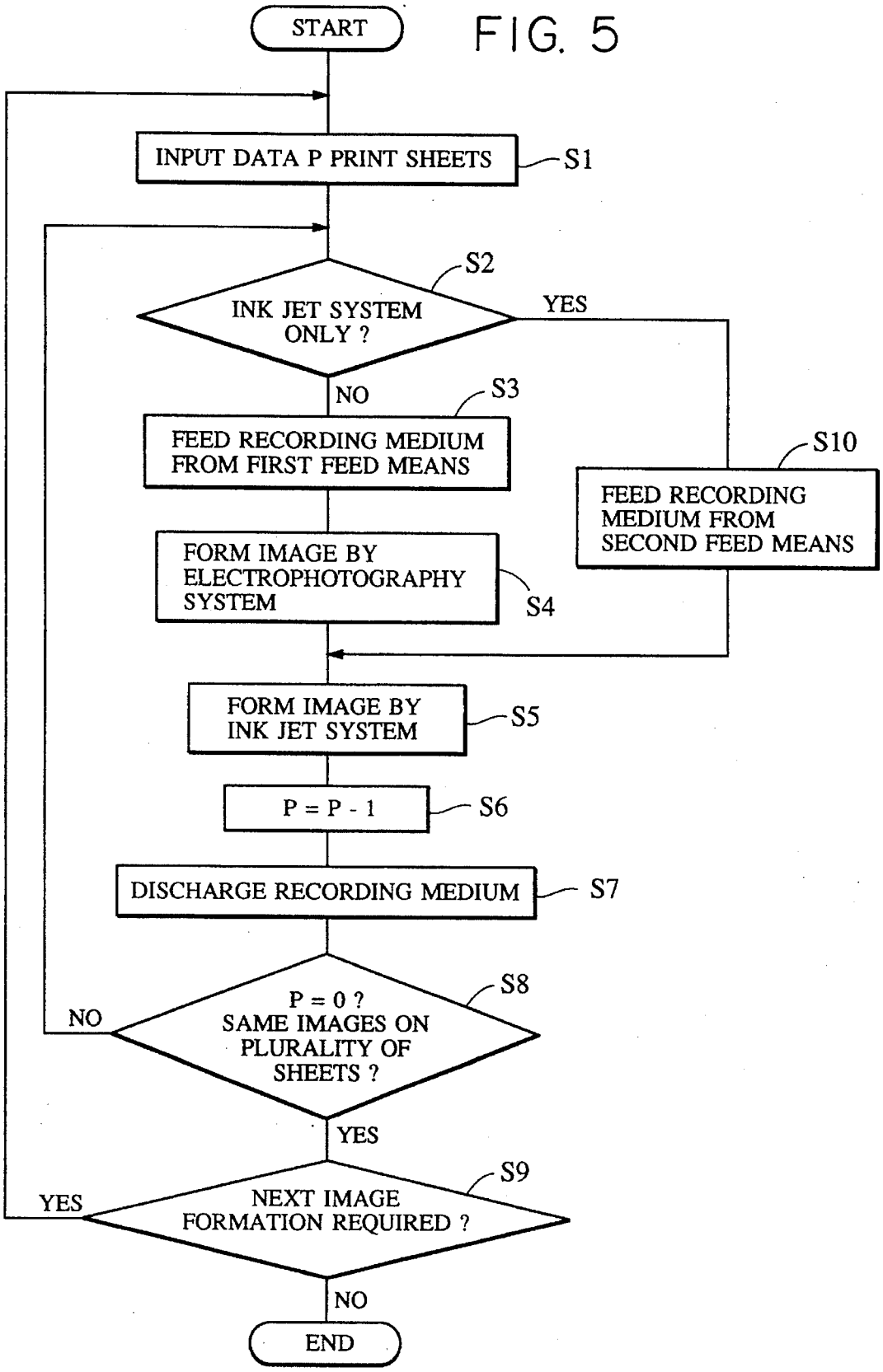
FIG. 5 is a flowchart of an image forming process.

The process of forming an image by the control system arranged as described above will be described with reference to the overall diagram of FIG. 1 and the flowchart of FIG. 5. First, image data, data on the number of copies and other kinds of data are input (Step S1), and a determination is made as to whether only color image recording, i.e., ink jet recording, is to be performed (Step S2).

In the case of two-way recording of a black-and-white image and a color image, the pickup roller 2 and the pair of registration rollers **3*a*, 3*b* are driven to supply and transport recording medium sheet P1 from the cassette 1 to the image forming section (Step S3), and the black-and-white image is formed by the electrophotography method using the above-described image forming means A (Step S4**).

After the formation of the black-and-white image, the recording medium P1 is transported to the second image forming means B through the discharge port 6, and the color image is formed by the second image forming means B (Step S5). As described above, the color image recording is performed by rotating the pair of transport rollers **12*a*, 12*b*, and the pair of discharge rollers 13*a*, 13*b* to transport the recording medium sheet P1 and by driving the recording head assembly 16 and the carriage 19 in synchronization with this transport. When the image formation by the second image forming means B is completed, the discharge rollers 14*a*, 14*b* are driven to discharge the recording medium sheet P1 onto the discharge portion 15 (Steps S6, S7**).

Next, a determination is made as to whether the above-described recording operation has been repeated to obtain the set number of print sheets (Step S8). If the set number of copies is not reached, the process returns to Step 2 to repeated the above-described sequence of operations. If the set number is reached, a determination is them made as to whether execution of the next image formation is required (Step S9). If YES, the process returns to Step 1. If NO, the process comes to an end.

If it is recognized in Step S2 that only ink jet recording is to be performed, the process moves to Step S10 without driving the first image forming means A. In Step S10, the pickup rollers **26*a*, 26*b* are driven to feed one recording medium sheet P2 set on the manual insertion tray 25. The process then moves to Step S5** to perform the above-described ink jet recording operation.

As described above, means Z1 for supplying recording medium P2 is provided between the first image forming means A and the second image forming means B. It is therefore possible to form an image without passing the medium through the fixation means 5 of the first image forming means A, if the image is to be formed only by color recording. Accordingly, it is also possible to set on the manual insertion tray 25 an OHP sheet which can be easily affected by heat and which is specially provided for ink jet recording. Thus, color image recording, performed by image forming means B with advantage, can be performed easily and conveniently.

Second Embodiment

Figure 6:
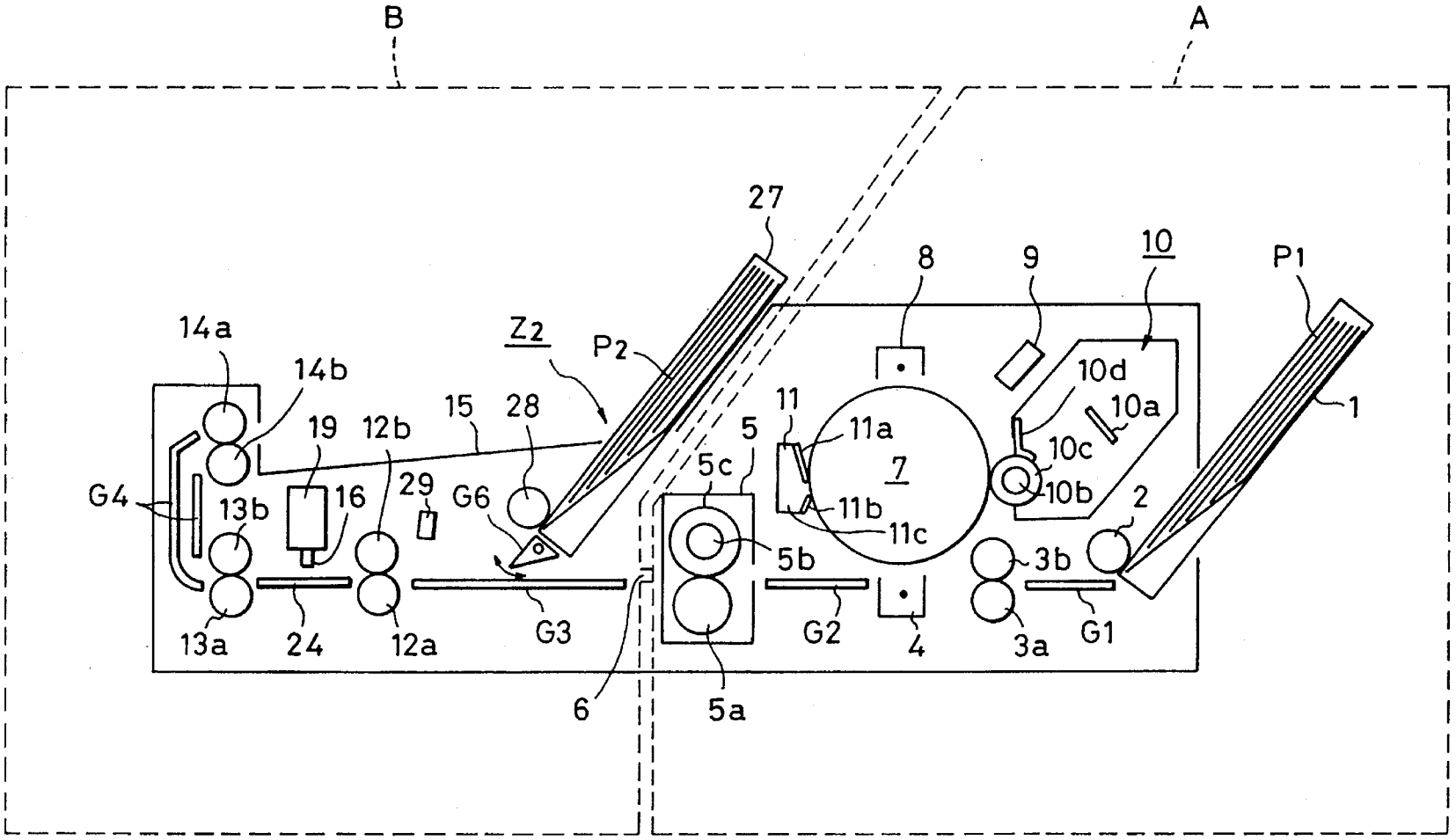
FIG. 6 is a schematic diagram of the overall construction of an image forming apparatus in accordance with a second embodiment of the present invention.

The second embodiment of the present invention will be described with reference to FIG. 6. This embodiment has components having the same functions and arranged in the same manner as those of the first embodiment. The corresponding components are indicated by the same reference characters.

In the second embodiment, a cassette 27 is used as means Z2 for supplying recording medium P2 provided between the first image forming means A and the second image forming means B, and a multiplicity of recording medium sheets P2 can be contained in the cassette 27. A pickup roller 28, a pair of transport rollers 12*a*, 12*b*, and a pair of discharge rollers 13*a*, 13*b* are arranged so as to be each rotatable in normal and reverse directions. A flapper G6 provided as a guide member is formed into a comb-like shape with a triangular profile and is swingably attached, as shown in FIG. 6. In this embodiment, a sensor 29 for detecting the trailing end of each recording medium sheet P1 is provided between the flapper G6 and the pair of transport rollers 12*a*, 12*b* to enable recording medium sheets P1 discharged from the first image forming means A and passed through the discharge port 6 to be stacked in the cassette 27.

Figure 7:
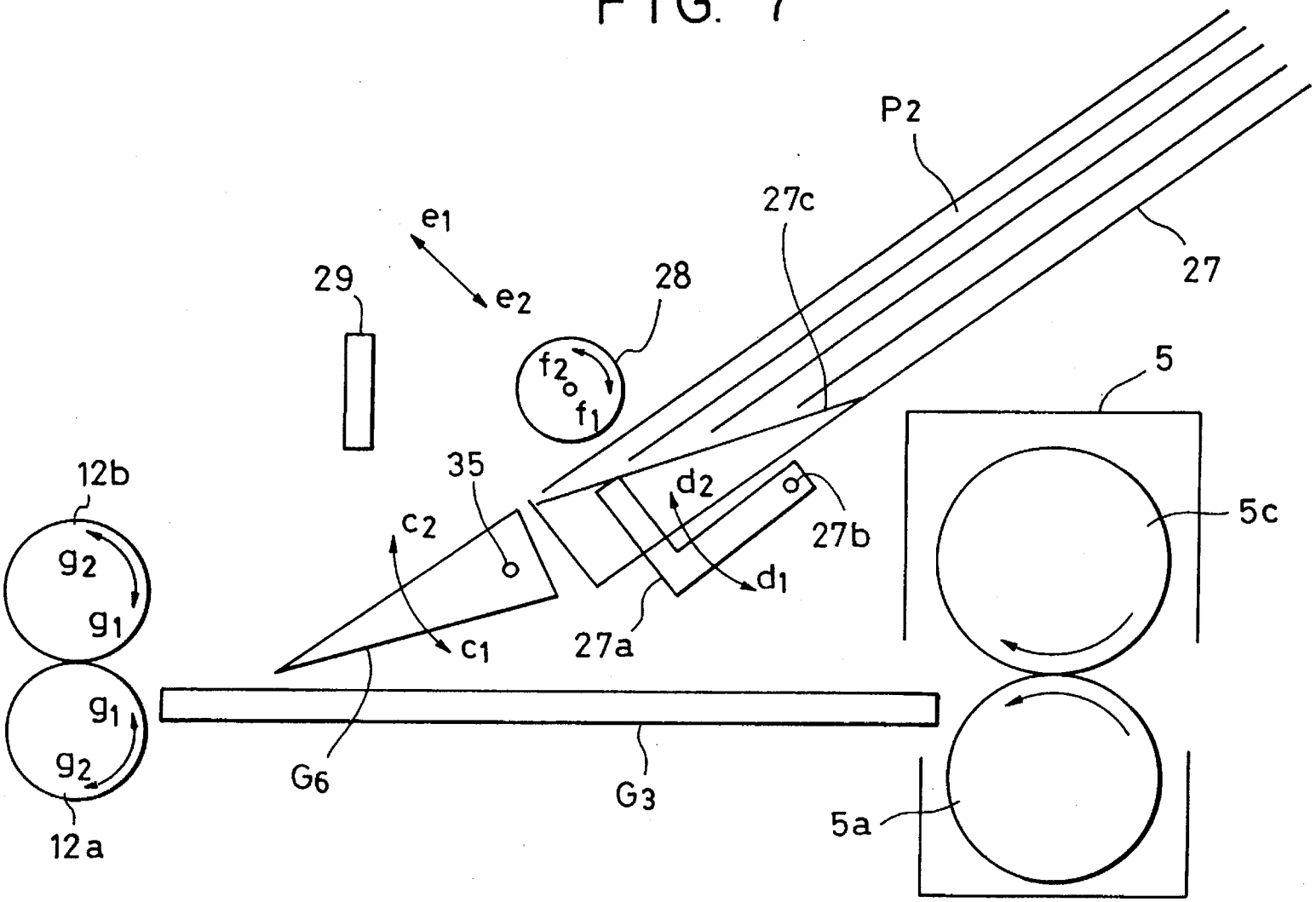
FIG. 7 is a diagram of the construction of a stacking mechanism.

For this operation, the flapper G6 is attached so as to be swingable on a shaft 35 in the directions of arrows c1 and c2, as shown in FIG. 7. An intermediate plate 27*c* of the cassette 27 is also swingable with a pivotal motion of a feed/discharge adjustment member 27*a* on a shaft 27*b*. Also, the pickup roller 28 is movable in the directions of arrows e1 and e2. The flapper G6, the intermediate plate 27*a* and the pickup roller 28 are moved in the directions indicated by the arrows according to the operation of stacking recording medium sheets P1, as described below. This image forming apparatus is controlled by the same control system as that of the first embodiment in accordance with control processes described below with reference to the flowcharts of FIGS. 8 through 12.

Overall Image Forming Process

Figure 8:
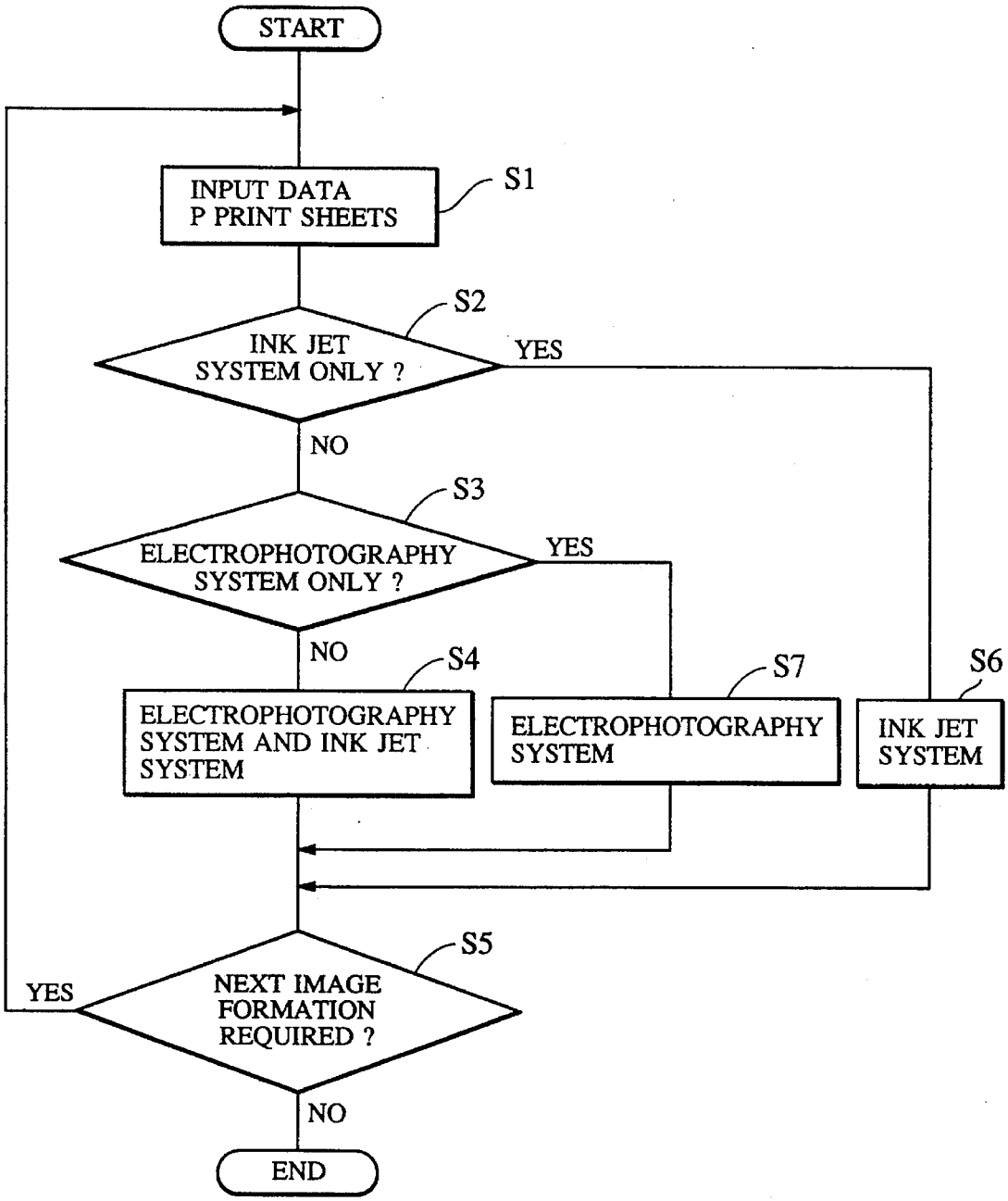
FIG. 8 is a flowchart of an overall image forming process of the second embodiment.

FIG. 8 shows an overall image forming process. In Step S1, image data, data on the number of copies and other kinds of data are input. In Step S2, a determination is made as to whether or not an image to be recorded is formed only of a color image, that is, formed by ink jet recording. In the case of performing only color image recording, the process moves to Step S6 to feed one recording medium sheet P2 out of the cassette 27 and to perform ink jet recording by the second image recording means B. Thereafter, the process moves to Step S5 to make a determination as to whether or not execution of the operating of the next image formation is required. If NO, the process comes to an end. IF YES, the process returns to Step S1.

On the other hand, it is determined in Step 2 that the image to be recorded is not formed only of a color image, the process advances to Step S3 to make a determination as to whether the image to be recorded is formed only of a black-and-white image, that is, formed only by electrophotographic recording. In the case of performing only black-and-white image recording, the process moves to Step S7 to perform electrophotographic recording by feeding a recording sheet from the cassette 1 and by using the first image forming means A, and the process thereafter moves to Step S5.

If it is determined in Step S3 that the image to be formed is not formed only of a black-and-white image, that is, if an image consisting of a mixture of a color image and a black-and-white image will be formed one surface of the recording medium sheet, the process advances to Step S4. In Step S4, one recording medium sheet P1 is fed out of the cassette 1, electrophotographic recording is performed by the first image forming means A, and the recording medium sheet P1 is thereafter fed to the second image forming means B to perform ink jet recording. Thereafter, the process advances to Step S5.

Ink Jet Recording Process

Figure 9:
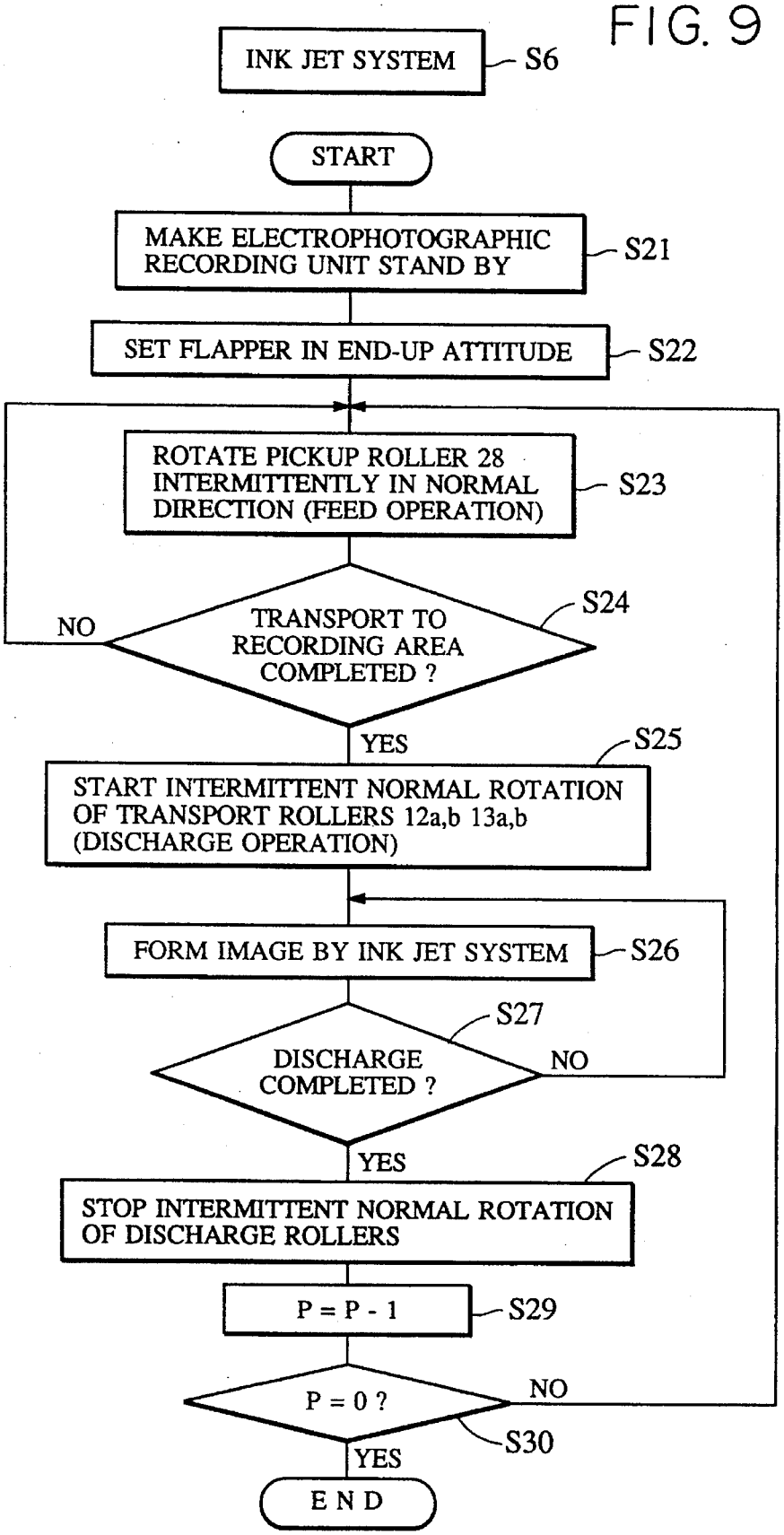
FIG. 9 is a flowchart of a process of performing only ink jet recording.

Ink jet recording in Step S6 is performed in accordance with a process shown in the flowchart of FIG. 9. This process will be described with reference to FIGS. 7 and 9.

In the case of performing only ink jet recording, the electrophotographic recording unit, i.e., the first image forming means A, is set in a standby state in Step S21 shown in FIG. 9. In Step S22, the flapper G6 is swung in the direction of arrow c2 so that its swinging end is turned upwardly. In Step S23, the adjusting member 27*a* is operated so as to upwardly move the intermediate plate 27*c* in the direction of arrow d2 shown in FIG. 7, and the pickup roller 28 is moved in the direction of arrow e2 to be pressed against the recording medium sheet P2 and is intermittently rotated in the normal direction (in the direction of arrow f1 shown in FIG. 7) to feed the recording medium sheet P2 out of the cassette 27. In Step S24, the state of the recording medium P2 transported to the recording area is detected. Then, in Step S25, the pair of transport rollers 12*a*, 12*b*, and the pair of discharge rollers 13*a*, 13*b* are intermittently rotated in the normal direction (in the direction of arrow g1 in FIG. 7) to transport the recording medium sheet P2. In Step S26, the recording head assembly 16 and the carriage 19 are driven in synchronization with the transport of the recording medium P2 to perform ink jet recording.

Next, in Steps S27 and S28, the recording medium P2 on which a color image has been recorded is discharged onto the discharge portion 15, and the operating of driving the pair of transport rollers 12*a*, 12*b*, and the pairs of discharge rollers 13*a*, 13*b*, 14*a*, 14*b* is stopped. In Steps S29 and S30, a determination is made as to whether the ink jet recording process has been repeated to obtain the set number of copies. If NO, the process returns to Step S23. If YES, the recording operation is terminated.

Electrophotographic Recording Process

Figure 10:
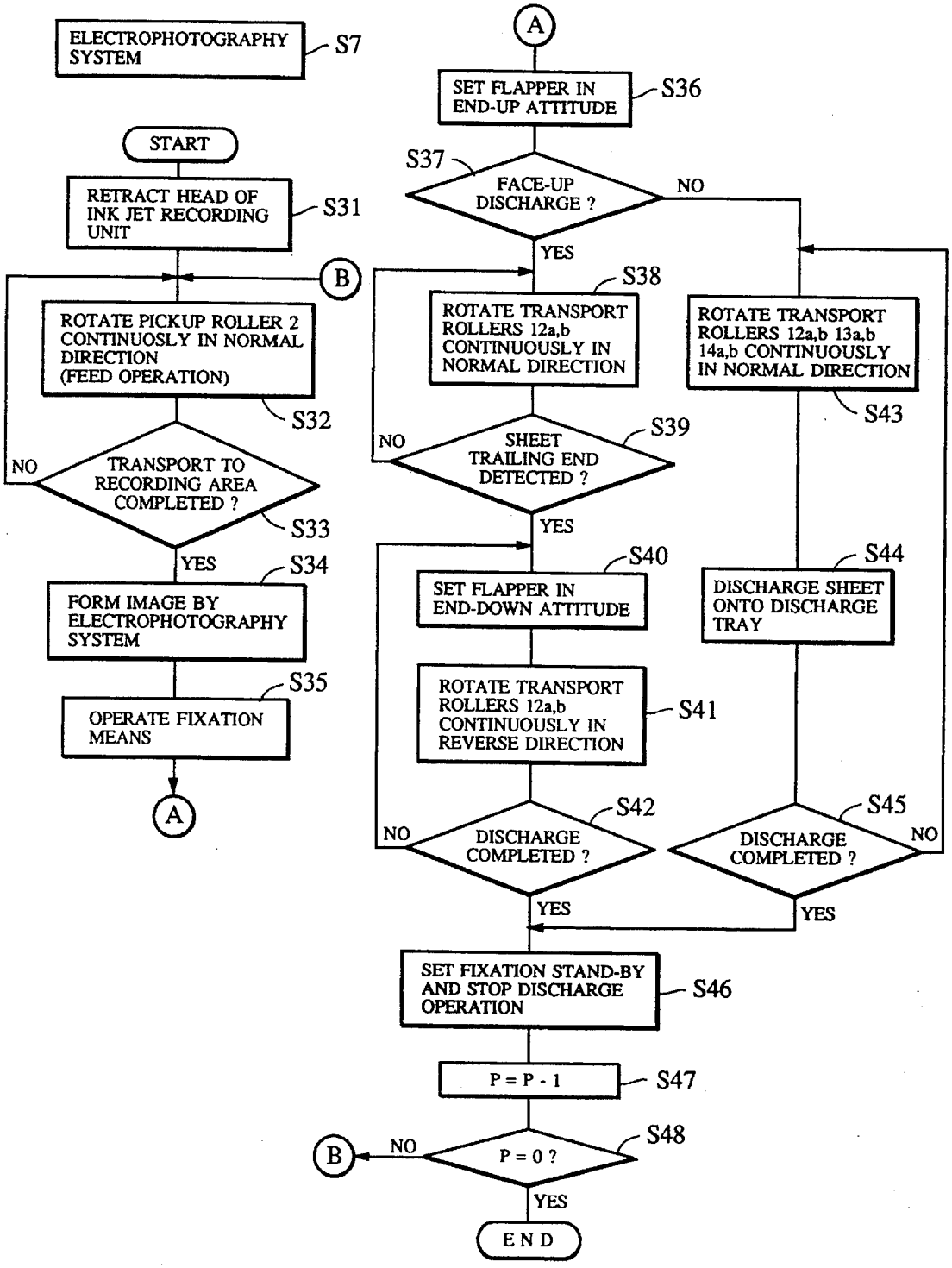
FIG. 10 is a flowchart of a process of performing only electrophotographic recording.

Electrophotographic recording in Step S7 of FIG. 8 is performed in accordance with a process shown in the flowchart of FIG. 10. This process will be described with reference to FIGS. 6, 7 and 10.

In the case of performing only electrophotographic recording, the head assembly 16 of the ink jet recording unit of the second image forming means B is retracted in Step S31 of FIG. 10. In Step S32, the pickup roller 2 is continuously rotated in the normal direction (the direction of feeding of recording medium P1) to feed one recording medium sheet P1 out of the cassette 1. In Step S33, the state of the recording medium sheet P1 transported to the recording area is detected. Then, a black-and-white electrophotographic image is formed in Step S34, and the transferred toner image is fixed on the recording medium Sheet P1 in Step S35.

Next, in Step S36, the swinging end of the flapper G6 is turned upwardly to enable the recording medium sheet P1 to move into the second image forming means B. The recording medium sheet P1 is then discharged. In this embodiment, it is possible to previously select face-up discharging, i.e., a method of discharging the recording medium sheet P1 into the cassette 27 in such a manner that the image recording surface faces upward or a face-down discharging, i.e., a method of discharging the recording medium sheet P1 onto the discharge portion 15 in such a manner that the image recording surface faces downward.

In Step S37, therefore, a determination is made as to whether the discharge method is face-up discharging or face-down discharging. In the case of a face-up discharging, the process advances to Step S38 to rotate the pair of transport rollers 12*a*, 12*b*, and the pair of discharge rollers 13*a*, 13*b* in the normal direction for discharging. In Step S39, when the trailing end of the recording medium sheet P1 passes the flapper G6, the trailing end is detected by the sensor 29. Then, in Step S40, the flapper G6 is swung in the direction of arrow c1 shown in FIG. 7 to bring its swinging end into contact with the guide member G3. Simultaneously, the pickup roller 28 is withdrawn in the direction of arrow e1 and the adjusting member 27*a* is swung in the direction of arrow d1 to downwardly move the intermediate plate 27*c* in the direction of arrow d1. In this state, in Step S41, the pair of transport rollers 12*a*, 12*b*, and the pair of discharge rollers 13*a*, and 13*b* are rotated in the reverse direction; that is in the direction of arrows g2 shown in FIG. 7. The recording medium sheet P1 is thereby switched back to be discharged into the cassette 27 while being guided by the flapper G6.

After a certain time has elapsed from when the sensor 29 detects the leading end of the recording medium sheet P1 switched back, the adjusting member 27*a*, shown in FIG. 7, is swung in the direction of arrow d2 to upwardly move the intermediate plate 27*c* in the direction of arrow c2. Simultaneously, the pickup roller 28 is moved in the direction of arrow e2 to be brought into contact with the discharged recording medium sheet P1, and is rotated in the direction of arrow f2 to completely discharge the recording medium sheet P1 into the cassette 27. In Step S42, the completion of this discharge is detected. Then, the flapper G6 is swung in the direction of arrow c2 shown in FIG. 7 to be ready to pass the recording medium sheet P1 next introduced, and the operation of driving the transport rollers 12*a*, 12*b*, and the discharge rollers 13*a*, 13*b* is stopped. Further, the process advances to Step S46 to set the fixation means 5 in the standby state.

On the other hand, if in Steps S37 and S38 the discharge method is set to face-down discharging, the process moves to Step S43 to rotate the transport rollers 12*a*, 12*b*, and the discharge rollers 13*a*, 13*b*, and 14*a*, 14*b* in the normal direction. The recording medium P1 is thereby transported along the guide member G4 to be discharged onto the discharge portion 15 in step S44. The completion of discharging is detected in Step S45. The process then advances to Step S46 to set the fixation means in the standby state.

In Steps S47 and S48, a determination is made as to whether the electrophotography recording and discharging process has been completed with respect to the set number of copies. If NO, the process returns to Step S32. If YES, the recording operation is terminated.

Electrophotographic Recording and Ink Jet Recording Process

Figure 11:
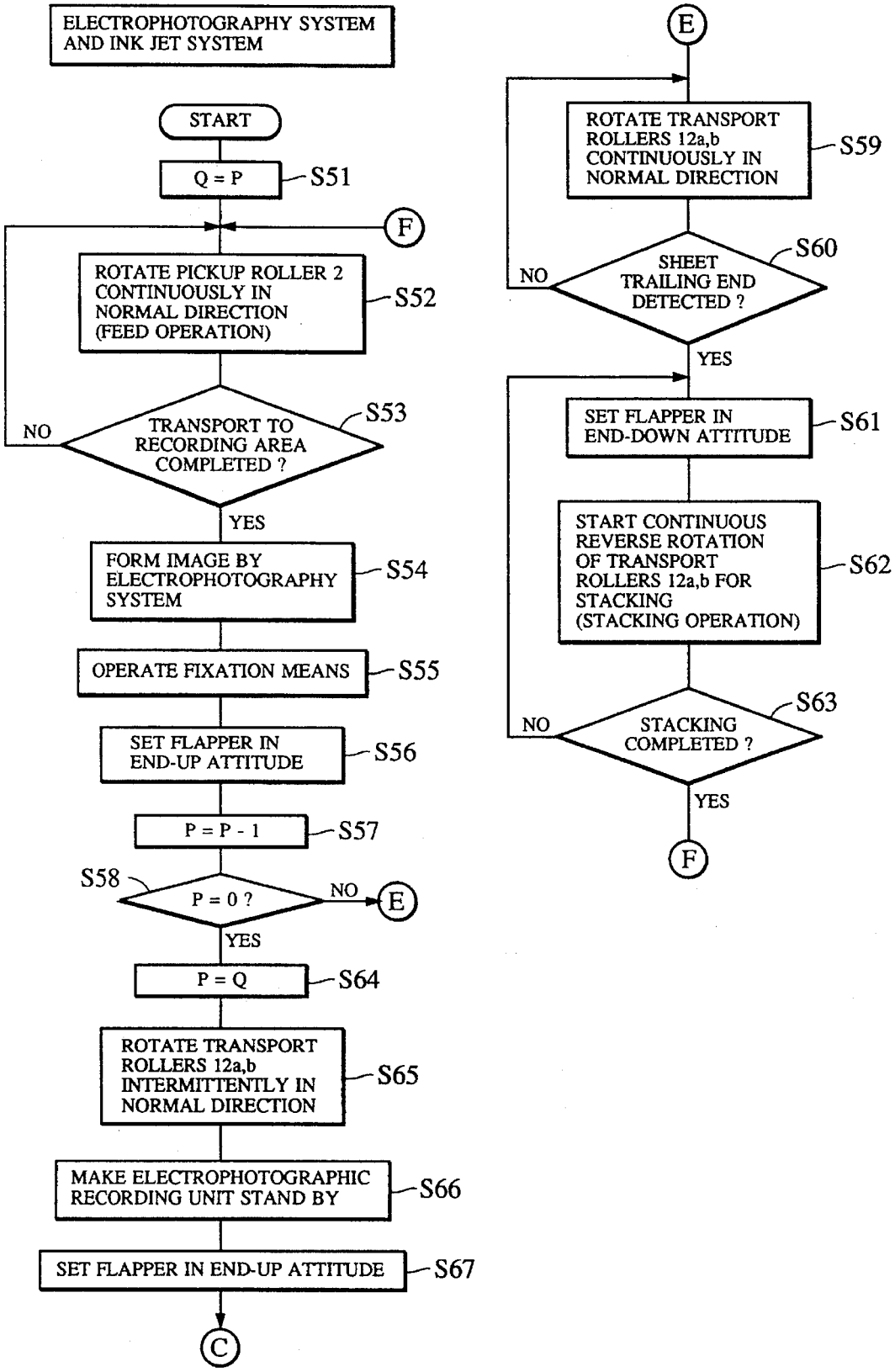
FIG. 11 is a flowchart of a process of performing electrophotographic recording and ink jet recording.
Figure 12:
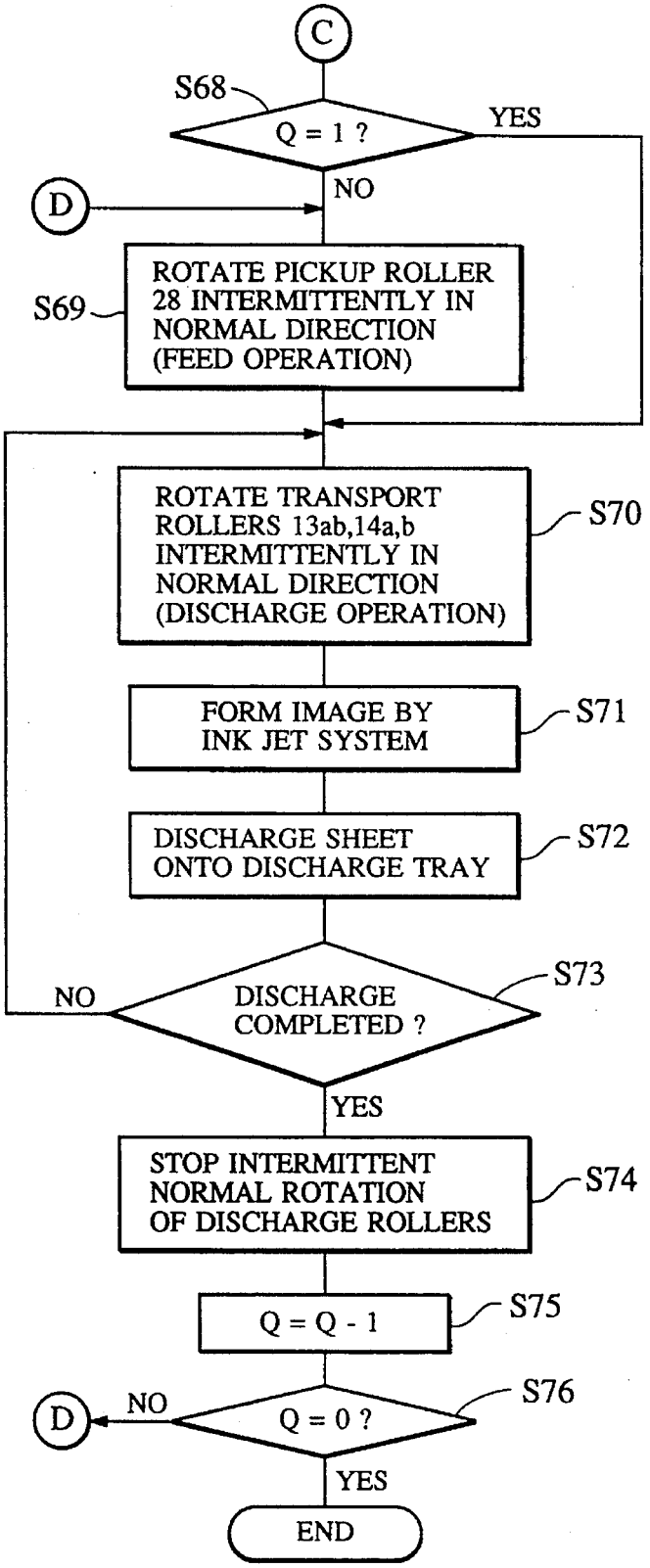
FIG. 12 is a flowchart continued from FIG. 11.

Electrophotographic recording and ink jet recording in Step 4 of FIG. 8 are performed in accordance with the process shown in the flowcharts of FIGS. 11 and 12. This process will be described with reference to FIGS. 6, 7, 11 and 12.

Referring to FIG. 11, in Step S51, the number of recording sheers P is set. In Step S52, the pickup roller 2 is rotated in the normal direction to feed one recording medium sheet P1 out of the cassette 1. In Step S53, the state of the recording medium sheet P1 transported to the recording area is detected. In Step S54, a black-and-white electrophotographic image is formed. In Step S55, the transferred toner image is fixed on the recording medium sheet P1.

Next, in Step S56, the swinging end of the flapper G6 is turned upwardly to enable the recording medium sheet P1 to move into the second image forming means B. If it is determined in Steps S57 and S58 that the number of remaining recording sheets is not zero, the process advances to Step S59 to transport the recording medium P1 by rotating the pair of transport rollers 12*a*, 12*b*, and the pair of discharge rollers 13*a*, 13*b* in the normal direction.

In Step S60, the trailing end of the recording medium P1 is detected by the sensor 29. Then, in Steps S61 to S63, the recording medium sheet P1 is stacked in the cassette 27 by the above-described face-up discharging procedure. That is, the flapper G6 is swung in the direction of arrow c1 shown in FIG. 7 to bring the swinging end into contact with the guide member G3. Simultaneously, the pickup roller 28 is withdrawn in the direction of arrow e1, and the adjusting member 27*a* is swung in the direction of arrow d1 to downwardly move the intermediate plate 27*c* in the direction of arrow d1. In this state, in Step S62, the pair of transport rollers 12*a*, 12*b* and the pair of discharge rollers 13*a*, 13*b* are moved in the reverse direction. The recording medium sheet P1 is thereby switched back and discharged into the cassette 27 while being guided by the flapper G6. After a certain time has elapsed from when the sensor 29 detects the leading end of the recording medium P1 switched back, the adjusting member 27*a* is swung in the direction of arrow d2 shown in FIG. 7 to upwardly move the intermediate plate 27*c* in the direction of arrow c2. Simultaneously, the pickup roller 28 is moved in the direction-of arrow e2 to be brought into contact with the discharged recording medium sheet P1, and is rotated in the direction of arrow f2 to completely discharge the recording medium sheet P1 into the cassette 27. In Step S63, the completion of this discharge is detected. Then, the flapper G6 is swung in the direction of arrow c2 shown in FIG. 7 to be ready to pass the recording medium sheet P1 next introduced, and the operation of driving the transport rollers 12*a*, 12*b*, and the discharge rollers 13*a*, 13*b* is stopped.

As described above, the process of successively forming desired image on a plurality of recording medium sheets by the first image forming means A, and successively stacking the recording medium sheets P1 in the cassette 27 is repeated. If it is determined in Step S58 that the image formation on the last one of the plurality of recording medium sheets has been completed, then the process advances to Steps S64 and S65 to feed the last recording medium sheet into the second image forming means B by rotating the pair of transport rollers 12*a*, 12*b*, and the pairs of discharge rollers 13*a*, 13*b*, and 14*a*, 14*b* in the normal direction without stacking it in the cassette 27.

The image forming operation of the second image forming means B is then started. At this time, however, the first image forming means A is set in the standby state at step S66, i.e., a power saving mode such that the power consumption of the first image forming means A is reduced. In Step S67, the extreme end of the flapper G6 is turned upwardly. In Step S68, a determination is made as to whether or not the recording medium sheet presently fed is the first one of the recording medium sheets for recording by the second image forming means B, i.e., the recording medium sheets P1 transported into the second image forming means B without being stacked in the cassette 27. In the case of the first sheet, the process moves to Step S70. In the case of one of the other subsequent sheets stacked in the cassette 27, the process advances to Step S69 to feed the sheet out of the cassette 27 by intermittently rotating the pickup roller 28 in the normal direction; that is, the direction f1 shown in FIG. 7.

In Steps S70 to S72, the transport rollers 12*a*, 12*b*, and the discharge rollers 13*a*, 13*b*, and 14*a*, 14*b* are intermittently rotated in the normal direction to transport the recording medium sheet P1, and ink jet recording is performed in synchronization with this transport. After recording, the recording medium sheet P1 is discharged onto the discharge portion 15. In Step S73, the completion of discharging is detected. Then, in Step S74, the operation of rotating the pair of transport rollers 12*a*, 12*b*, and pairs of discharge rollers 13*a*, 13*b*, and 14*a*, 14*b* is stopped.

Electrophotographic recording and ink jet recording are performed on the recording medium P1 in the above-described manner. In Steps S75 and S76, a determination is made as to whether recording on the set number of recording has been completed. If NO, the process returns to Step S69. If YES, the recording operation is terminated.

In the image forming apparatus in accordance with the second embodiment, three image forming methods shown below can be practiced, as described above with respect to the recording procedure.

(1) A method of setting one or more recording medium sheets P2 in the cassette 27, transporting each recording medium sheet P2 by the pickup roller 28, the pair of transport rollers 12*a*, 12*b*, and other means, performing only color image recording by the second image forming means B, and thereafter discharging the recording medium sheet, (2) A method of forming one image recording sheet P1 by the first image forming means A and successively discharging the recording medium sheet P1 in a face-up or face-down manner, and (3) A method of forming a black-and-white image on one image recording sheet P1 by the first image forming means A, setting one or more image recording sheets P1 with the recorded image in the cassette 27, forming a color image on each sheet by the second image forming means B, and discharging the sheets onto the discharge portion 15.

Since the first image forming means A is not used when image forming is performed by the second image forming means B, the power source for the image forming means A can be turned off. Accordingly, a power limit means may be provided which, when images are formed only by the second image forming means B, turns off the power source for the fixation means 5, a cooling fan and the like in the first image forming means A, which require large electric power and always require temperature adjustment, or sets the first image forming means A in a low power consumption mode. In this manner, the total power consumption of the image forming apparatus can be reduced.

In the case of the image forming method (3), it is possible to set a comparatively large recording area for the second image forming means B. It is also possible to avoid a problem due to the difference between the processing speeds of the first and second image forming means A when the number of image forming sheets is large.

Figure 13:
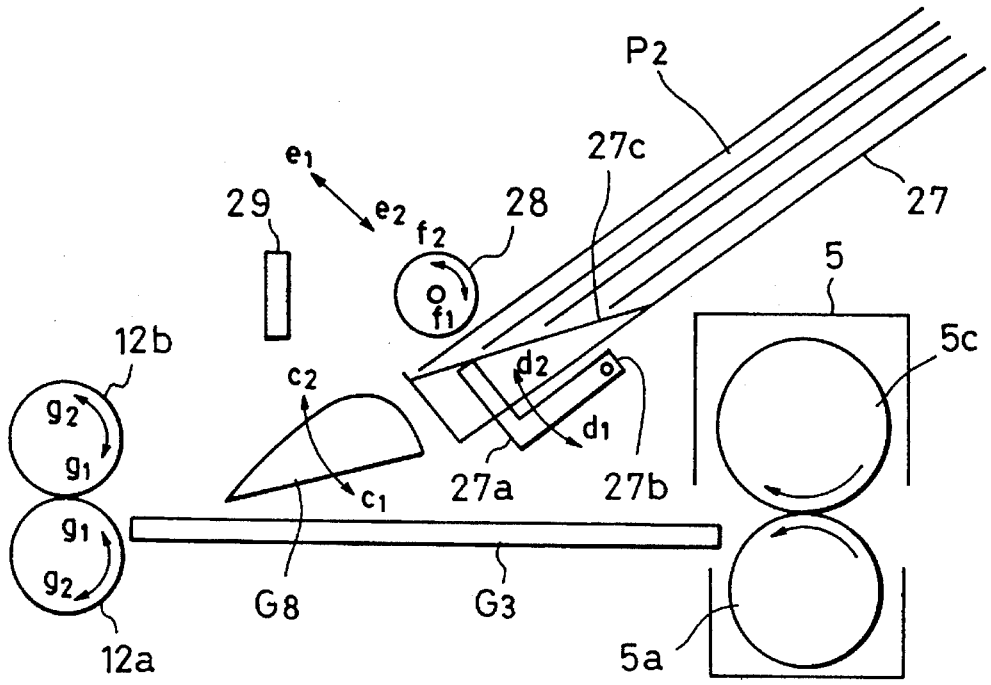
FIG. 13 is a diagram of the construction of another example of the stacking mechanism.
Figure 14:
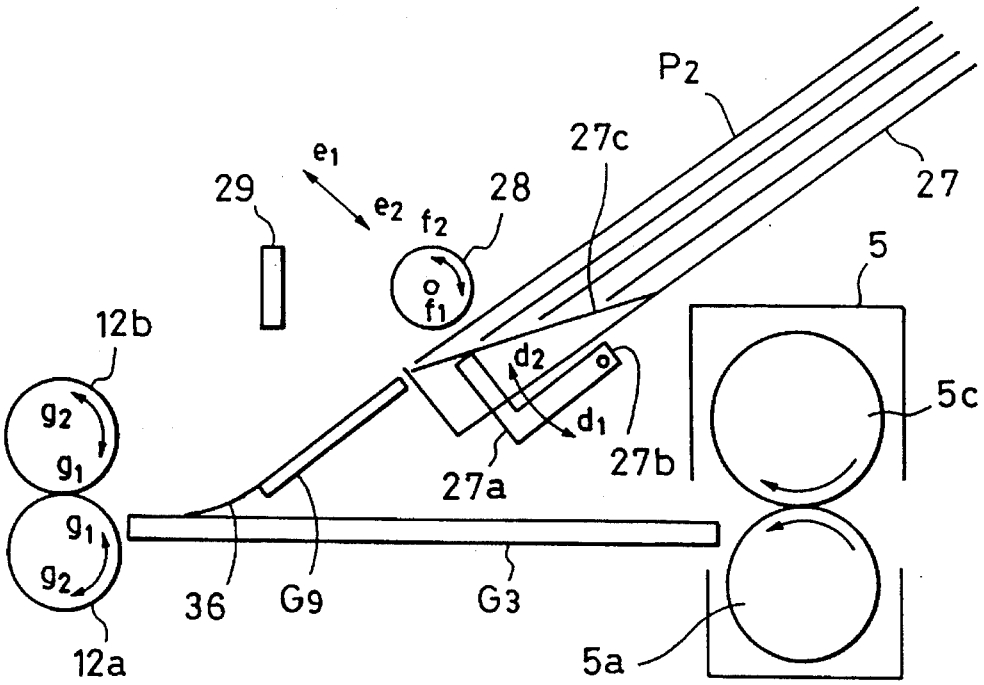
FIG. 14 is a diagram of the construction of still another example of the stacking mechanism.

In the second embodiment described above, flapper G6 having a triangular profile, such as shown in FIG. 7, is swung to stack recording medium sheets P1 used for recording by the first image forming means A stacked in the cassette 27. However, the profile of the flapper G6 is not limited to such a triangular shape. For example, as shown in FIG. 13, a flapper G8 swingable as indicated by the arrows and having a generally semicircular profile may be used. Further, the arrangement may alternatively be such that, as shown in FIG. 14, a guide member G9 having a polyethylene telephthalate film 36 attached to its extreme end is fixed so that the film 36 contacts the guide member G3, and each recording medium sheet P1 transported from the first image forming means A is fed into the second image forming means B by upwardly displacing the film 36.

Third Embodiment

Figure 15:
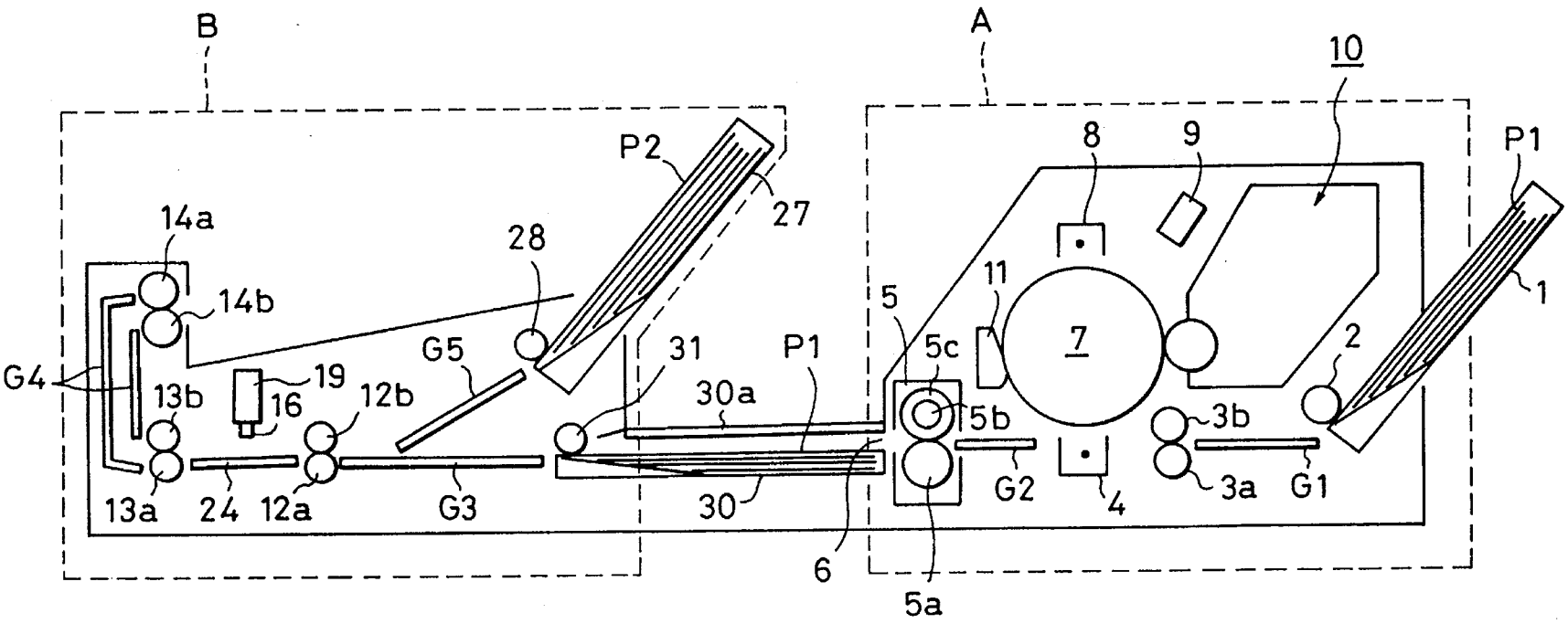
FIG. 15 is a schematic diagram of the overall construction of an image forming apparatus in accordance with a third embodiment of the present invention.

The third embodiment of the present invention will be described with reference to FIG. 15. Components having the same functions as those of the first and second embodiments are indicated by the same reference characters, and will not be specially described.

In the third embodiment, an intermediate stacking cassette 30 is provided between the first image forming means A and the second image forming means B. That is, recording medium sheets P1 discharged through the discharge port 6 of the first image forming means A are stacked in the cassette 30 and each of the stacked sheet is supplied to the second image forming means B by a pickup roller 31.

In the image forming apparatus thus constructed, three image forming methods shown below can be practiced.

(1) A method of forming an image on one recording medium sheet P1 by the first image forming means and successively forming an image by the second image forming means B, (2) A method of forming an image on one recording medium sheet P1 by the first image forming means A, discharging the recording medium P1 into the cassette 30, stacking recording medium sheets P1 on which images are formed by the first image forming means A, and forming an image by the second image forming means B after the completion of image formation on a plurality of recording medium sheets P1 by the first image forming means A, and (3) A method of setting one or more recording medium sheets P2 in the cassette 27, transporting each recording medium sheet P2 by the pickup roller 28, the pair of transport rollers 12*a*, 12*b*, and other means, and performing only color image recording by the second image forming means B.

These methods will be described below excepting the method (3), which is the same as the one described above with respect to the second embodiment.

In the method (1), a black-and white image is formed on one recording medium sheet P1 from the cassette 1 by the first image forming means A, as in the first embodiment, and the recording medium sheet P1 is discharged through the discharge port 6 into the cassette 30. This recording medium sheet P1 is fed into the second image forming means B by driving and rotating the pickup roller 31. Thereafter, as in the case of the first embodiment, a color image is formed on the recording medium sheet P1 by the second image forming means B, and the sheet is thereafter discharged onto the discharge portion 15.

In the method (1), electrophotographic recording (face-down discharging) is possible if the recording head assembly 16 is withdrawn so that no color image cannot be formed.

In the method (2), a black and-white image is formed on one recording medium sheet P1 by the first image forming means A, and the recording medium sheets P1 is temporarily set in the cassette 30, which also serves as a stacking means. These steps are repeated a certain number of times to stack a plurality of recording medium sheets P1 in the cassette 30. When image forming by the first image forming means A is thereby completed, the pickup roller 31 is driven to perform color image recording by the second image forming means B.

Also in the method (2), it is possible to perform only electrophotographic recording (face-up discharging) in such a manner that a black and-white image is formed on one recording medium sheet P1 by the first image forming means A, the recording medium sheets P1 is temporarily set in the cassette 30, and, after these steps have been repeated a certain number of times, the recording medium sheets P1 in the cassette 30 are taken out by opening a top cover 30*a* of the cassette 30.

Also in the case of the method (2), it is possible to reduce the power consumption by providing the above-mentioned power limit means and by cutting power to one of the first and second image forming means A and B while the other is being driven, since the image forming operations of the first and second image forming means A and B are performed independently of each other, as described above with respect to the second embodiment.

In the method (2), while image forming is being performed by the first image forming means A to stack recording medium sheets P1 in the cassette 30, recording medium sheets P2 can be supplied to the second image forming means B from the cassette 27 to perform image forming by the second image forming means B.

Further, while image forming is being performed by the image forming means B by feeding recording medium sheets P2 from the cassette 27, the result of recording of the first image forming means A can be confirmed or taken out by opening the top cover 30*a* of the cassette 30.

Fourth Embodiment

Figure 16:
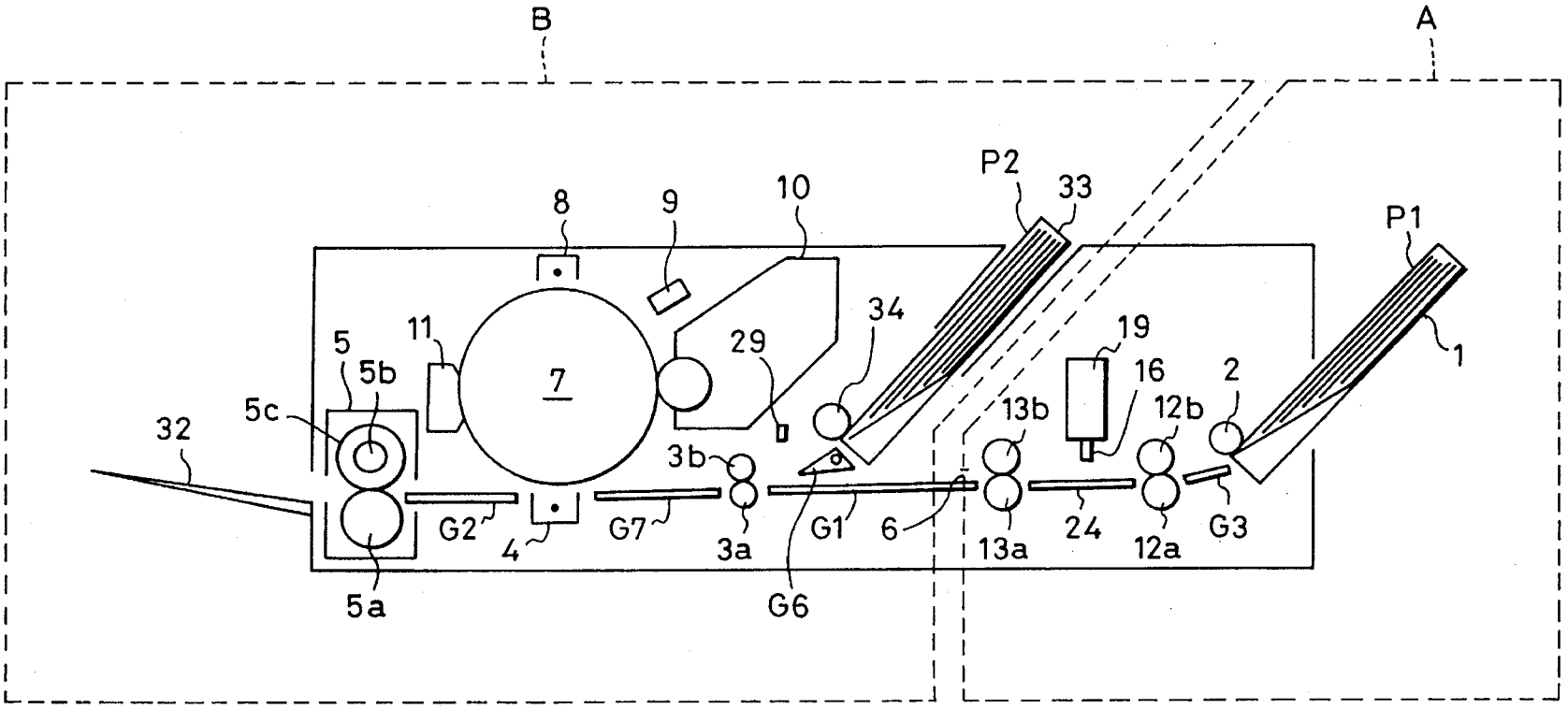
FIG. 16 is a schematic diagram of the overall construction of an image forming apparatus in accordance with a fourth embodiment of the present invention.
Figure 17:
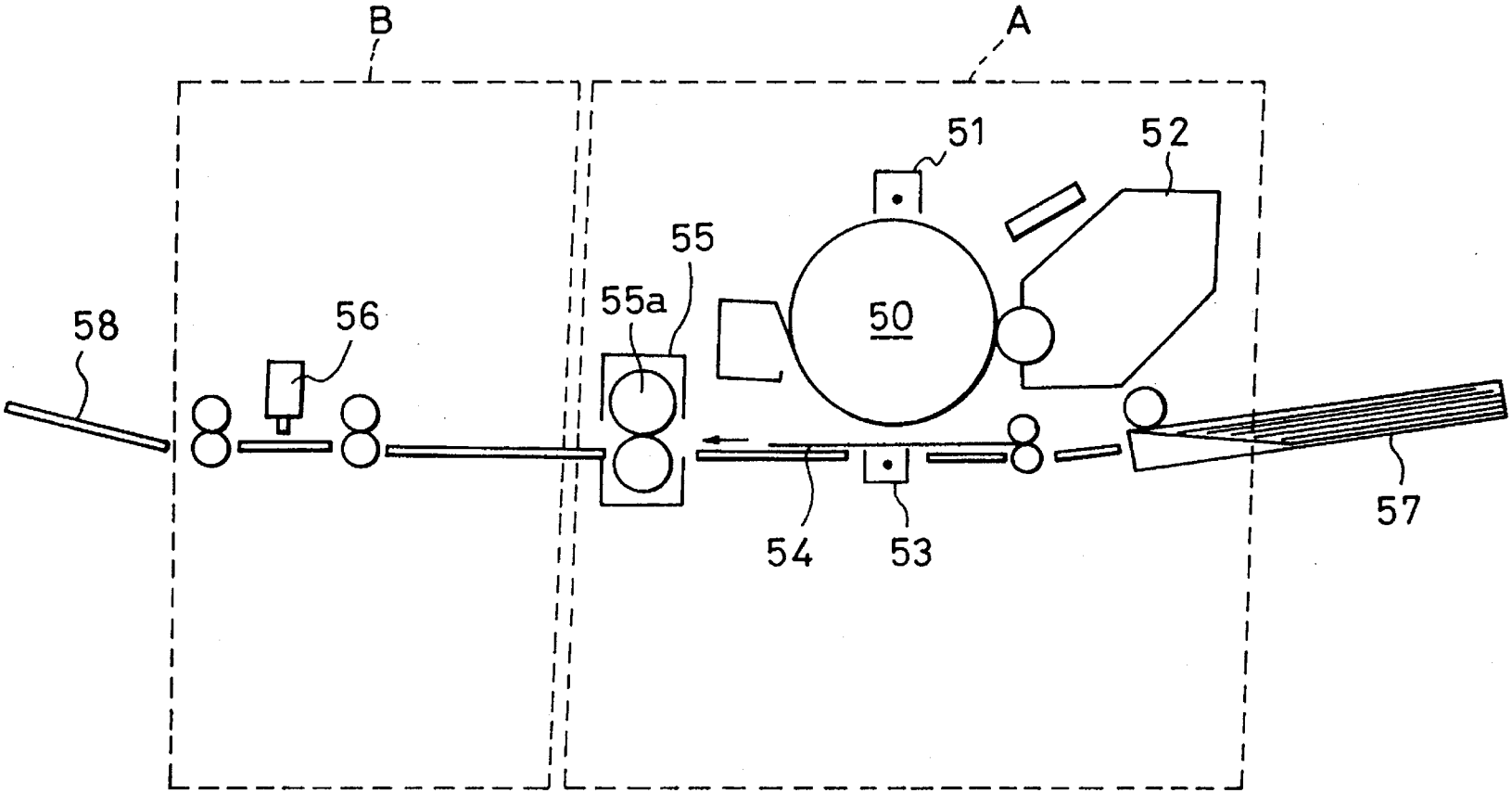
FIG. 17 PRIOR ART
FIG. 17 is a diagram of an image forming apparatus of the related conventional art.

The fourth embodiment of the present invention will be described with reference to FIG. 16. Components having the same functions as those of the first and second embodiments are indicated by the same reference characters, and will not be specially described.

As the first or second embodiment, an example of the image forming apparatus has been described in which an electrophotography system is used as the first image forming means, while an ink jet recording system is used as the second image forming means. A black-and-white image is first formed on one recording medium sheet P1 by the electrophotography system, and color recording is thereafter performed on the sheet by ink jet recording system. However, the arrangement may alternatively be such that, as shown in FIG. 16, an ink jet recording system is used as the first image recording means while an electrophotography system is used as the second image forming means.

In this case, color recording is performed on one recording medium sheet P1 by the ink jet recording system of the first image forming means A, and the recording medium sheet P1 is then sent to the second image forming means B to have a black-and-white image formed thereon by the electrophotography system and is thereafter discharged onto a discharge tray 32.

In the case of recording only a black-and-white image, each of recording medium sheets P2 in a cassette 33 constituting a supply means provided between the first image forming means A and the second image forming means B is supplied to the second image forming means B by a pickup roller 34, a pair of registration rollers 3*a*, 3*b*, and a guide member G7, only a black-and-white image is recorded on the recording medium sheet P2, and the sheet is thereafter discharged into the discharge tray 32.

In the case of performing one-point-color recording or using an OHP sheet provided specially for ink jet recording, each recording medium on which an image has been formed by ink jet recording is discharged into the cassette 33 by using a flapper G6 as in the second embodiment. In this manner, only a color image can be formed.

In this case, since each recording medium P2 does not pass through the nip between the pair of transport rollers 12*a*, 12*b* of the ink jet recording system, contaminations of a paper powder and other materials on the ink jet recording heads can be reduced and the wear of the transport rollers and other members is limited. Also, the recording medium transport path can be shortened. It is therefore possible to achieve improved performance as an advantage of the electrophotography system, i.e., high-speed high-quality image recording.

Other Embodiments

As examples of image forming means arranged for the above-described embodiments based on different image forming methods, an electrophotography system and an ink jet system have been described. The present invention, however, is not limited to these recording systems, and other recording systems, for example, thermal recording or thermal transfer recording systems can be adopted.

Preferably, the ink jet recording system, used as a recording means in the above-described embodiments, is arranged as described below.

That is, it is preferable to arrange a recording system in such a manner that a current is caused to flow through an electrothermal transducer in accordance with a recording signal so that thermal energy is applied to ink by the electrothermal transducer to cause film boiling of ink, and the ink is ejected through an outlet by the growth and contraction of a bubble caused in the ink by the film boiling.

For example, as a typical example of such a system, a system based on the fundamental principles described in the specification of U.S. Pat. Nos. 4,723,129 and 4,740,796 is preferably used. This system can be applied to either of on-demand type and continuous type of recording apparatuses. If this system is applied to an on-demand type, at least one drive signal for causing an abrupt increase in the temperature of a liquid (ink) exceeding a temperature rise causing nucleate boiling in accordance with recording information is applied to an electrothermal transducer facing a sheet or channel containing the liquid to generate thermal energy in the electrothermal transducer, whereby film boiling is caused in the thermal action surface of the recording head. As a result, a bubble can be formed in the liquid (ink) corresponding to the drive signal in a one-to-one relationship. Therefore, an application to an on-demand type of recording apparatus is particularly effective. The liquid (ink) is ejected through an ejection opening by the growth and collapse of such a bubble to form at least one liquid droplet. It is preferable to form the drive signal as a pulse-like signal, because a bubble can be instantaneously grown and collapsed in a suitable manner so that the response of liquid (ink) ejection is improved.

As such a pulse-like drive signal, a drive signal such as that described in the specification of U.S. Pat. No. 4,463,359 or 4,345,262 is suited.

If the condition of the rate of temperature rising at the above-mentioned thermal action surface described in the specification of U.S. Pat. No. 4,313,124 is adopted, the recording performance can be further improved.

The present invention also comprises, as a recording head structure, the arrangements disclosed in U.S. Pat. Nos. 4,558,333 and 4,459,600, wherein a thermal action portion is disposed in a bent area, as well as arrangements using a combination of an ejection outlet, a liquid passage and an electrothermal transducer, such as those disclosed in the specifications of the above-mentioned patents.

The present invention is also advantageous even in the case of using a head structure based on the art disclosed in Japanese Laid-Open Patent Publication No. 123670/1984, which discloses an arrangement using a common slit as an ejection section for a plural electrothermal transducers, and Japanese Laid-Open Patent Publication No. 138461/1984, which discloses an arrangement in which an opening for absorbing pressure waves of thermal energy is formed in correspondence with an ejection section. That is, the present invention ensures reliable efficient recording no matter what the type of recording head is used.

Further, the present invention is also effective with respect to a full-line type of recording head having a length corresponding to a maximum width of recording medium sheets usable in the image forming apparatus.

Such a recording head may be constructed by combining a plurality of recording heads so as to satisfy such a length condition, or may be constructed as one integrally-formed recording head.

There are other various kinds of recording heads usable in accordance with the present invention, as well as the above-mentioned serial type of recording head. For example, a recording head fixed to the apparatus body, an interchangeable chip type of recording head which can be electrically connected to the apparatus body and can be supplied with ink from the apparatus body when mounted on a carriage, or a cartridge type of recording head integrally combined with an ink tank may be used.

It is preferable to add a recording head ejection recovery means, an auxiliary preparatory means and the like to the ink jet recording system used in image forming apparatuses of the above-described embodiments, because the effect of the present invention can be further stabilized thereby. Such means are, for example, a means for capping the recording head, a cleaning means, a pressurization or attraction means, a means for preliminary heating using an electrothermal conversion type heating element, any other type of heating element or a combination of such heating elements, and a means for ejection in a preliminary ejection mode other than ejection for recording.

The kind and the number of recording heads mounted on the carriage may be selected as desired. For example, only one head may be provided for monochromatic recording, or a plurality of heads may be provided in correspondence with a plurality of inks differing in recording color and density. That is, the present invention is also applicable to a recording apparatus having at least one of a recording mode for multicolor recording in two or more colors and a recording mode for full-color recording using mixed colors, regardless of use of one integrally-constructed recording head or a combination of a plurality of recording heads, as well as for a recording apparatus having only a recording mode for recording in a popularly-used color such as black.

The embodiments of the present invention have been described by assuming that the ink used is a liquid. However, an ink which can solidify at a temperature equal to or lower than room temperature and which softens or liquefies at room temperature may also be used. Also, an ink having a liquid form when an operating recording signal is applied may be used, since in ordinary liquid jet recording systems, the temperature of ink is controlled in the range of 30° to 70° C., so that the viscosity of ink is within a stable ejection range. Further, an undesirable increase in temperature of ink may be prevented by positively utilizing the temperature rise caused by thermal energy as energy for a change in the state of ink from a solid state to a liquid state, or an ink which solidifies when left in a certain condition may be adopted for the purpose of preventing evaporation of ink. In any cases, the present invention can be applied to an arrangement using an ink having such a property as to be liquefied only when thermal energy is applied, e.g., an ink which is liquefied by application of thermal energy in accordance with a recording signal to be ejected in a liquid form, and an ink which starts solidifying when it reaches a recording sheet.

Such ink may be retained as a liquid or solid material in through holes or recesses formed in a porous sheet to face an electrothermal transducer, as disclosed in Japanese Laid-Open Patent Publication No. 56847/1979 or Japanese Laid-Open Patent Publication No. 71260/1985. In accordance with the present invention, the above-described film boiling system is most effective if one of such inks is used.

The above-described image forming apparatus may be formed as an apparatus used as an image output terminal for information processors such as computers, a copying machine combined with a reader or the like, or a facsimile apparatus having transmitting and receiving functions.

According to the above-described embodiments of the present invention, a plurality of image forming means based on different image forming methods are provided, and a recording medium supply means is provided between adjacent image forming means. Therefore, one of the image forming means can operate at its optimal performance level without being affected by the other.

The supply means may also be used as an intermediate recording medium stacking means to make it possible to turn off the power source for one of the two image forming means while driving the other to form images on a plurality of recording sheets. It is therefore possible to reduce the total power consumption.

According to the present invention, as described above, an image forming apparatus can be provided which is capable of forming a high-quality black-and-white image as well as a high-quality a color image. Also, according to the present invention, an image forming apparatus can be provided in which two image forming means do not affect each other when only a black-and-white image is formed by one of the two image forming means or when only a color image is formed by the other image forming means.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a recording medium, comprising:

first image forming means for forming an image on the recording medium using an ink jet image forming method;

second image forming means for forming an image on the recording medium using an electrophotographic image forming method;

a first recording medium transport passage for discharging the recording medium out of the apparatus after the recording medium has passed through said first and second image forming means;

a second recording medium transport passage for discharging the recording medium out of the apparatus without passing the recording medium through said second image forming means after the recording medium has passed through said first image forming means; and a third recording medium transport passage for discharging the recording medium out of the apparatus without passing the recording medium through said first image forming means after the recording medium has passed through said second image forming means.

2. An apparatus according to claim 1, further comprising recording head means used in accordance with the ink jet image forming method, said recording head means having, as a device for generating energy utilized to eject ink, an electrothermal transducer capable of generating thermal energy for causing film boiling in ink.

3. An apparatus according to claim 2, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

4. An apparatus according to claim 3, wherein each of said first, second, third, and fourth heads is mounted on a carriage and is reciprocatingly movable in a main scanning direction.

5. An apparatus according to claim 1, wherein the second image forming method used by said second image forming means is an electrophotographic image forming method, and said second image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said second image forming means being capable of forming a black-and-white image.

6. An apparatus according to claim 1 or 4, wherein said first image forming means using an ink jet image forming method is disposed at an upstream position along a recording medium transport direction of said first recording medium transport passage, while said second image forming means using an electrophotographic image forming method is disposed at a downstream position along the recording medium transport direction.

7. An apparatus according to claim 1, wherein said first and second recording medium transport passages have a portion common to each other.

8. An apparatus according to claim 7, wherein said first and third recording medium transport passages have a portion common to each other.

9. An image forming apparatus for forming an image on a recording medium, comprising:

first image forming means for forming an image on the recording medium using an ink jet image forming method;

second image forming means for forming an image on the recording medium using an electrophotographic image forming method;

first stacking means for stacking the recording medium to be fed to said first image forming means;

second stacking means for stacking the recording medium to be fed to said second image forming means;

first receiving means for receiving the recording medium on which an image is formed;

second receiving means for receiving the recording medium on which an image is formed;

a first recording medium transport passage for discharging the recording medium out of the apparatus after the recording medium has passed through said first and second image forming means;

a second recording medium transport passage for discharging to said first receiving means the recording medium fed out of said first stacking means after the recording medium has passed through said first image forming means; and a third recording medium transport passage for discharging to said second receiving means the recording medium fed out of said stacking means after the recording medium has passed through said second image forming means.

10. An apparatus according to claim 9, further comprising recording head means used in accordance with the ink jet image forming method, said recording head means having, as a device for generating energy utilized to eject ink, an electrothermal transducer capable of generating thermal energy for causing film boiling in ink.

11. An apparatus according to claim 10, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

12. An apparatus according to claim 11, wherein each of said first, second, third, and fourth heads is mounted on a carriage and is reciprocatingly movable in a main scanning direction.

13. An apparatus according to claim 9 or 12, wherein the second image forming method used by said second image forming means is an electrophotographic image forming method, and said second image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said second image forming means being capable of forming a black-and-white image.

14. An apparatus according to claim 9, wherein said first image forming means using an ink jet image forming method is disposed at an upstream position along a recording medium transport direction of said first recording medium transport passage, while said second image forming means using an electrophotographic image forming method is disposed at a downstream position along the recording medium transport direction.

15. An apparatus according to claim 13, wherein said first image forming means using an ink jet image forming method is disposed at an upstream position along a recording medium transport direction of said first recording medium transport passage, while said second image forming means using an electrophotographic image forming method is disposed at a downstream position along the recording medium transport direction.

16. An apparatus according to claim 9, wherein said first and second recording medium transport passages have a portion common to each other.

17. An apparatus according to claim 9, wherein said first and third recording medium transport passages have a portion common to each other.

18. An apparatus according to claim 9, wherein the recording medium transported through said first recording medium transport passage is discharged to said second receiving means.

19. An apparatus according to claim 9 or 12, wherein said second stacking means is positioned between said first and second image forming means along a recording medium transport direction of said first recording medium transport passage.

20. An image forming apparatus for forming an image on a recording medium, comprising:

first image forming means for forming an image on the recording medium using a first image forming method;

second image forming means for forming an image on the recording medium using a second image forming method;

first stacking means for stacking the recording medium to be fed to the first image forming means;

second stacking means for stacking the recording medium to be fed to the second image forming means;

first receiving means for receiving the recording medium on which an image is formed;

second receiving means for receiving the recording medium on which an image is formed;

a first recording medium transport passage for discharging to said first receiving means the recording medium fed out of said first stacking means after the recording medium has passed through said first image forming means and then through said second image forming means;

a second recording medium transport passage branching off said first recording medium transport passage on the downstream side of said first image forming means and on the upstream side of said second image forming means along a recording medium transport direction, the recording medium on which an image has been formed by said first image forming means being discharged to said second receiving means through said second recording medium transport passage; and a third recording medium transport passage for discharging to said first receiving means the recording medium fed out of said second stacking means after the recording medium has passed through said second image forming means.

21. An apparatus according to claim 20, wherein said second image forming means uses an ink jet image forming method of forming an image by ejecting ink through an outlet.

22. An apparatus according to claim 21, further comprising recording head means used in accordance with the ink jet image forming method, said recording head means having, as a device for generating energy utilized to eject ink, an electrothermal transducer capable of generating thermal energy for causing film boiling in ink.

23. An apparatus according to claim 22, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

24. An apparatus according to claim 23, wherein each of said first, second, third, and fourth heads is mounted on a carriage and is reciprocatingly movable in a main scanning direction.

25. An apparatus according to claim 22, wherein the first image forming method used by said first image forming means is an electrophotographic image forming method, and said first image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said first image forming means being capable of forming a black-and-white image.

26. An apparatus according to 20 or 24, wherein said second image forming means using an ink jet image forming method is disposed at a downstream position along a recording medium transport direction of said first recording medium transport passage, while said first image forming means based on an electrophotographic image forming method is disposed at an upstream position along the recording medium transport direction.

27. The apparatus according to claim 22, further comprising a flapper, wherein the recording medium fed out of said first stacking means is transported through one of said first and second recording medium transport passages by being selectively introduced thereinto by said flapper, after the recording medium has passed through said first image forming means using an electrophotographic image recording method.

28. An apparatus according to claim 22, wherein said first and second recording medium transport passages have a portion common to each other.

29. An apparatus according to claim 22, wherein said first and third recording medium transport passages have a portion common to each other.

30. An apparatus according to claim 22, wherein the recording medium transported through said first recording medium transport passage is discharged to said second receiving means.

31. An apparatus according to claim 22 or 24, wherein said second stacking means is positioned between said first and second image forming means along a recording medium transport direction of said first recording medium transport passage.

32. An apparatus according to claim 26, wherein said first and third recording medium transport passages have a portion common to each other.

33. An image forming apparatus for forming an image on a recording medium, comprising:

first image forming means for forming an image on the recording medium using an electrophotographic image forming method;

second image forming means for forming an image on the recording medium using an ink jet image forming method of forming an image by ejecting ink through an outlet;

a first recording medium transport passage for discharging the recording medium out of the apparatus after the recording medium has passed through said first and second image forming means;

a second recording medium transport passage for discharging the recording medium out of the apparatus without passing the recording medium through said second image forming means after the recording medium has passed through said first image forming means; and a third recording medium transport passage for discharging the recording medium out of the apparatus without passing the recording medium through said first image forming means after the recording medium has passed through said second image forming means.

34. An apparatus according to claim 33, further comprising recording head means used in accordance with the ink jet image forming method, said recording head means having, as a device for generating energy utilized to eject ink, an electrothermal transducer capable of generating thermal energy for causing film boiling in ink.

35. An apparatus according to claim 34, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

36. An apparatus according to claim 35, wherein each of said first, second, third, and fourth heads is mounted on a carriage and is reciprocatingly movable in a main scanning direction.

37. An apparatus according to claim 33, wherein said first image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said first image forming means being capable of forming a black-and-white image.

38. An apparatus according to claim 33 or 36, wherein said second image forming means using the ink jet image forming method is disposed at a downstream position along a recording medium transport direction of said first recording medium transport passage, while said first image forming means using the electrophotographic image forming method is disposed at an upstream position along the recording medium transport direction.

39. An apparatus according to claim 33, wherein said first and second recording medium transport passages have a portion common to each other.

40. An apparatus according to claim 33 or 39, wherein said first and third recording medium transport passages have a portion common to each other.

41. An image forming apparatus for forming an image on a recording medium, comprising:

first image forming means for forming an image on the recording medium using an electrophotographic image forming method;

second image forming means for forming an image on the recording medium using an ink jet image forming method of forming an image by ejecting ink through an outlet;

first stacking means for stacking the recording medium to be fed to said first image forming means;

second stacking means for stacking the recording medium to be fed to said second image forming means;

first receiving means for receiving the recording medium on which an image is formed;

second receiving means for receiving the recording medium on which an image is formed;

a first recording medium transport passage for discharging the recording medium out of the apparatus after the recording medium has passed through said first and second image forming means;

a second recording medium transport passage for discharging to said first receiving means the recording medium fed out of said first stacking means after the recording medium has passed through said first image forming means; and a third recording medium transport passage for discharging to said second receiving means the recording medium fed out of said second stacking means after the recording medium has passed through said second image forming means.

42. An apparatus according to claim 41, further comprising recording head means used in accordance with the ink jet image forming method, said recording head means having, as a device for generating energy utilized to eject ink, an electrothermal transducer capable of generating thermal energy for causing film boiling in ink.

43. An apparatus according to claim 42, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

44. An apparatus according to claim 43, wherein each of said first, second, third, and fourth heads is mounted on a carriage and is reciprocatingly movable in a main scanning direction.

45. An apparatus according to claim 41 or 44, wherein said first image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said first image forming means being capable of forming a black-and-white image.

46. An apparatus according to claim 41, wherein said second image forming means using the ink jet image forming method is disposed at a downstream position along a recording medium transport direction of said first recording medium transport passage, while said first image forming means based on the electrophotographic image forming method is disposed at an upstream position along the recording medium transport direction.

47. An apparatus according to claim 45, wherein said second image forming means using the ink jet image forming method is disposed at a downstream position along a recording medium transport direction of said first recording medium transport passage, while said first image forming means based on the electrophotographic image forming method is disposed at an upstream position along the recording medium transport direction.

48. An apparatus according to claim 41, wherein said first and second recording medium transport passages have a portion common to each other.

49. An apparatus according to claim 41 or 48, wherein said first and third recording medium transport passages have a portion common to each other.

50. An apparatus according to claim 41, wherein the recording medium transported through said first recording medium transport passage is discharged to said second receiving means.

51. An apparatus according to claim 41 or 44, wherein said second stacking means is positioned between said first and second image forming means along a recording medium transport direction of said first recording medium transport passage.

52. An image forming apparatus for forming an image on a recording medium, comprising:

first image forming means for forming an image on the recording medium using an electrophotographic image forming method;

second image forming means for forming an image on the recording medium using an ink jet image forming method of forming an image by ejecting ink through an outlet;

first stacking means for stacking the recording medium to be fed to said first image forming means;

second stacking means for stacking the recording medium to be fed to said second image forming means;

first receiving means for receiving the recording medium on which an image is formed;

second receiving means for receiving the recording medium on which an image is formed;

a first recording medium transport passage for discharging to said first receiving means the recording medium fed out of said first stacking means after the recording medium has passed through said first image forming means and then through said second image forming means;

a second recording medium transport passage branching off said first recording medium transport passage on the downstream side of said first image forming means and on the upstream side of said second image forming means along a recording medium transport direction, the recording medium on which an image has been formed by said first image forming means being discharged to said second receiving means through said second recording medium transport passage; and a third recording medium transport passage for discharging to said first receiving means the recording medium fed out of said second stacking means after the recording medium has passed through said second image forming means.

53. An apparatus according to claim 52, further comprising recording head means used in accordance with the ink jet image forming method, said recording head means having, as a device for generating energy utilized to eject ink, an electrothermal transducer capable of generating thermal energy for causing film boiling in ink.

54. An apparatus according to claim 53, wherein said recording head means comprises a first head for recording in a cyan color, a second head for recording in magenta color, a third head for recording in a yellow color, and a fourth head for recording in a black color, each of said first, second, third, and fourth heads having an array of a plurality of outlets, said recording head means being capable of forming a full-color image.

55. An apparatus according to claim 54, wherein each of said first, second, third, and fourth heads is mounted on a carriage and is reciprocatingly movable in a main scanning direction.

56. An apparatus according to claim 52, wherein said first image forming means comprises an electrophotographic photosensitive member, development means for developing a latent image formed on said electrophotographic photosensitive member, cleaning means for removing a developer remaining on said electrophotographic photosensitive member, transfer means for transferring a developer image formed on said electrophotographic photosensitive member to the recording medium, and fixation means for fixing on the recording medium the developer image transferred to the recording medium by said transfer means, said first image forming means being capable of forming a black-and-white image.

57. An apparatus according to any of claims 52, 55, or 56, wherein said second image forming means using an ink jet image forming method is disposed at a downstream position along a recording medium transport direction of said first recording medium transport passage, while said first image forming means using an electrophotographic image forming method is disposed at an upstream position along the recording medium transport direction.

58. The apparatus according to claim 52, further comprising a flapper, wherein the recording medium fed out of said first stacking means is transported through one of said first and second recording medium transport passages by being selectively introduced thereinto by said flapper, after the recording medium has passed through the recording medium has passed through said first image forming means.

59. An apparatus according to claim 52, wherein said first and second recording medium transport passages have a portion common to each other.

60. An apparatus according to claim 52 or 59, wherein said first and third recording medium transport passages have a portion common to each other.

61. An apparatus according to claim 52, wherein the recording medium transported through said first recording is discharged to said second receiving means.

62. An apparatus according to claim 52 or 55, wherein said second stacking means is positioned between said first and second image forming means along a recording medium transport direction of said first recording medium transport passage.

63. An image forming apparatus for forming an image on a recording medium, comprising:

a first image forming device for forming an image on the recording medium using an electrophotographic image forming method, said first image forming device having an electrophotographic photosensitive member, a developing sleeve, a charging member, a transfer charger, an image fixing member, and a cleaning member;

a second image forming device for forming an image on the recording medium using an ink jet image forming method of forming an image by ejecting ink through an outlet, said second image forming device having a plurality of recording head units having respective energy generating elements to eject ink droplets by imparting energy to a respective plurality of different colors of ink;

a first stacking cassette for stacking the recording medium to be fed to said first image forming device;

a second stacking cassette for stacking the recording medium to be fed to said second image forming device;

a first receiving portion for receiving, in a face-down position, the recording medium on which an image is formed;

a second receiving portion for receiving, in a face-up position, the recording medium on which an image is formed;

a first recording medium transport passage for discharging to said first receiving portion the recording medium fed out of said first stacking cassette after the recording medium has passed through said first image forming device and then through said second image forming device;

a second recording medium transport passage branching off said first recording medium transport passage on the downstream side of said first image forming device and on the upstream side of said second image forming device along a recording medium transport direction, the recording medium on which an image has been formed by said first image forming device being discharged to said second receiving cassette through said second recording medium transport passage; and a third recording medium transport passage for discharging to said first receiving portion the recording medium fed out of said second stacking cassette after the recording medium has passed through said second image forming device.

* * * * *

UNITED STATES PATENT AND TRADEMARK OFFICE

CERTIFICATE OF CORRECTION

PATENT NO. : 5,570,451 Page 1 of 3

DATED : October 29, 1996

INVENTOR(S) : KATSUHIRO SAKAIZAWA, ET AL.

It is certified that error appears in the above-indentified patent and that said Letters Patent is hereby corrected as shown below:

In the Drawings

SHEET 10 OF THE DRAWINGS:

Figure 10, in reference block S32, "CONTINUOSLY" should read --CONTINUOUSLY--.

COLUMN 8:

Line 65, "electrodes" should read --electrode--.

COLUMN 9:

Line 52, "C44," should read --C44, and--.

COLUMN 10:

Line 33, "them" should read --then--.

COLUMN 11:

Line 41, "it" should read --if it--; and
Line 55, "formed" should read --formed on--.

COLUMN 12:

Line 24, "operating" should read --operation--.

COLUMN 13:

Line 9, "and" should be deleted; and
Line 52, "sheers" should read --sheets--.

UNITED STATES PATENT AND TRADEMARK OFFICE

CERTIFICATE OF CORRECTION

PATENT NO. : 5,570,451

DATED : October 29, 1996

INVENTOR(S) : KATSUHIRO SAKAIZAWA, ET AL.

It is certified that error appears in the above-indentified patent and that said Letters Patent is hereby corrected as shown below:

COLUMN 14:

Line 20, "direction-of" should read --direction of--.

COLUMN 15:

Line 7, "recording" (second occurrence) should read --recording medium sheets--.

COLUMN 16:

Line 9, "sheet" should read --sheets--;
Line 49, "cannot" should read --can--;
Line 53, "sheets" should read --sheet--; and
Line 65, "sheets" should read --sheet--.

COLUMN 19:

Line 3, "plural" should read --plurality of--;
Line 8, "the" should be deleted; and
Line 67, "cases," should read --case,--.

COLUMN 20:

Line 34, "a" (second occurrence) should be deleted.

COLUMN 21:

Line 45, "claim 7," should read --claim 1 or 7,--.

UNITED STATES PATENT AND TRADEMARK OFFICE

CERTIFICATE OF CORRECTION

PATENT NO. : 5,570,451 Page 3 of 3

DATED : October 29, 1996

INVENTOR(S) : KATSUHIRO SAKAIZAWA, ET AL.

It is certified that error appears in the above-indentified patent and that said Letters Patent is hereby corrected as shown below:

COLUMN 22:

Line 65, "claim 9," should read --claim 9 or 16,--.

COLUMN 28:

Line 24, "the recording medium has passed through" should be deleted.

Signed and Sealed this

Twenty-ninth Day of April, 1997

Bruce Lehman

*Attest:*

BRUCE LEHMAN

*Attesting Officer*

*Commissioner of Patents and Trademarks*